US012508469B2

(12) United States Patent
Van Der Hoeven et al.

(10) Patent No.: US 12,508,469 B2
(45) Date of Patent: Dec. 30, 2025

(54) MODULAR RESISTANCE TRAINING SYSTEMS

(71) Applicant: Core 46 IP LLC, Irvine, CA (US)

(72) Inventors: Martin Van Der Hoeven, Irvine, CA (US); Carla Van Der Hoeven, Irvine, CA (US)

( * ) Notice: Subject to any disclaimer, the term of this patent is extended or adjusted under 35 U.S.C. 154(b) by 130 days.

(21) Appl. No.: 18/466,719

(22) Filed: Sep. 13, 2023

(65) Prior Publication Data

US 2024/0216742 A1 Jul. 4, 2024

Related U.S. Application Data

(60) Provisional application No. 63/406,507, filed on Sep. 14, 2022.

(51) Int. Cl.
*A63B 22/20* (2006.01)
*A63B 21/00* (2006.01)
(Continued)

(52) U.S. Cl.
CPC ..... *A63B 22/203* (2013.01); *A63B 21/0428* (2013.01); *A63B 21/0552* (2013.01);
(Continued)

(58) Field of Classification Search
CPC ..... A63B 21/00065; A63B 21/0414; A63B 21/0428; A63B 21/055; A63B 21/0552;
(Continued)

(56) References Cited

U.S. PATENT DOCUMENTS 3,784,193 A 1/1974 Simjian
4,434,981 A * 3/1984 Norton ..... A63B 22/0012 482/70
(Continued)

FOREIGN PATENT DOCUMENTS

DE 202008005296 U1 7/2008
KR 20110009523 U * 10/2011 ..... A63B 22/203
WO WO-0145801 A1 * 6/2001 ..... A63B 23/0417

OTHER PUBLICATIONS

"International Preliminary Report on Patentability (Chapter I of the Patent Cooperation Treaty)," for International Application No. PCT/US2023/74103, filed Sep. 13, 2023, prepared by the International Bureau on behalf of the United States Patent and Trademark Office, dated Mar. 1, 2025, 7 pages.
(Continued)

*Primary Examiner* — Gary D Urbiel Goldner
(74) *Attorney, Agent, or Firm* — Chang & Hale LLP

(57) ABSTRACT

An exercise system includes a chassis comprising a first board, a second board having one or more linear rails running along a lengthwise dimension of the chassis, a sled platform configured to couple to the one or more linear rails in a sliding engagement, and a resistance band dock coupled between the first board and the second board. The exercise system further includes an exercise bar stand comprising a fixed standing platform, first and second leg bases including lateral stabilizers disposed on opposite sides of the fixed standing platform, and an exercise bar projecting vertically from the first and second leg bases and including a horizontal crossbar portion.

12 Claims, 20 Drawing Sheets

(51) Int. Cl.
*A63B 21/04* (2006.01)
*A63B 21/055* (2006.01)
*A63B 26/00* (2006.01)

(52) U.S. Cl.
CPC ..... *A63B 21/0557* (2013.01); *A63B 21/4034* (2015.10); *A63B 21/4035* (2015.10); *A63B 26/003* (2013.01); *A63B 2208/0204* (2013.01); *A63B 2210/50* (2013.01); *A63B 2225/093* (2013.01)

(58) Field of Classification Search
CPC ..... A63B 21/0557; A63B 21/4029; A63B 21/4031; A63B 21/4034; A63B 21/4035; A63B 21/4045; A63B 22/203; A63B 2022/003; A63B 23/0405; A63B 2023/0411; A63B 26/003; A63B 69/0022; A63B 69/0057; A63B 2071/027; A63B 2208/0204; A63B 2210/50; A63B 2225/093
See application file for complete search history.

(56) References Cited

U.S. PATENT DOCUMENTS 4,512,571 A 4/1985 Hermelin
4,706,953 A * 11/1987 Graham ..... A63B 21/4009 482/133
5,042,797 A * 8/1991 Graham ..... A63B 22/001 482/110
5,295,935 A 3/1994 Wang
6,280,366 B1 * 8/2001 Hsieh ..... A63B 21/4045 482/130
7,637,855 B2 12/2009 Bizzell et al.
7,815,552 B2 10/2010 Dibble et al.
7,914,424 B1 3/2011 Krull
7,998,038 B2 8/2011 Keiser
8,100,815 B2 1/2012 Balaker et al.
8,465,399 B2 6/2013 Tommy, Jr. et al.
8,986,172 B2 3/2015 Poole
9,011,296 B2 4/2015 Peralo
9,555,278 B2 1/2017 Kaye et al.
9,682,267 B2 6/2017 Kaye et al.
10,232,213 B1 3/2019 Smith, Jr.
10,512,814 B1 * 12/2019 Conroy ..... A63B 21/00069
10,675,498 B2 6/2020 Kaye et al.
10,864,400 B2 12/2020 Schween
11,957,953 B2 * 4/2024 Rozo ..... A63B 23/0417
12,296,222 B2 * 5/2025 True ..... A63B 21/0428
2001/0036885 A1 * 11/2001 Castellot, Jr. ..... A63B 21/4015 482/79
2006/0205528 A1 * 9/2006 McMillan ..... A63B 69/3667 473/279
2007/0087921 A1 4/2007 Graham
2007/0135280 A1 * 6/2007 Hamer ..... A63B 23/0355 482/148
2009/0098983 A1 * 4/2009 Hoffman ..... A63B 71/0036 482/70
2010/0216614 A1 8/2010 Rivas
2011/0039667 A1 * 2/2011 Teng ..... A63B 23/0488 482/142
2012/0065030 A1 * 3/2012 Sandvig ..... A63B 21/4015 482/79
2012/0329618 A1 12/2012 White et al.
2012/0329620 A1 12/2012 White et al.
2014/0274605 A1 * 9/2014 McCanney ..... A63B 21/4035 482/129
2015/0065320 A1 3/2015 Anderson
2018/0169464 A1 6/2018 Janowski
2018/0290004 A1 10/2018 Lennox et al.
2019/0255379 A1 8/2019 Latronica et al.
2020/0298052 A1 9/2020 Dalmia et al.
2020/0376327 A1 12/2020 Bissonnette et al.
2021/0121726 A1 4/2021 Potapov
2021/0394005 A1 12/2021 Aronson et al.
2022/0023714 A1 * 1/2022 Holman ..... A63B 21/0428
2022/0387847 A1 * 12/2022 True ..... A63B 21/4033
2023/0405394 A1 12/2023 Davidson, II et al.
2024/0216754 A1 * 7/2024 Van Der Hoeven ..... A63B 21/0552
2024/0216755 A1 * 7/2024 Van Der Hoeven ..... A63B 21/0557

OTHER PUBLICATIONS

"International Search Report and Written Opinion of the International Searching Authority," for International Application No. PCT/US2023/74103, filed Sep. 13, 2023, prepared by the United States Patent and Trademark Office, dated Feb. 28, 2024, 7 pages.
"Written Opinion of the International Searching Authority" under PCT Rule 43bis. 1 for International Application No. PCT/US2023/74103, filed Sep. 13, 2023, prepared by the United States Patent and Trademark Office, dated Feb. 28, 2024, 7 pages.

* cited by examiner

MODULAR RESISTANCE TRAINING SYSTEMS

RELATED APPLICATION(S)

This application claims priority to U.S. Provisional Patent Application Ser. No. 63/406,507, filed on Sep. 14, 2022 and entitled PERSONAL EXERCISE SYSTEMS, the complete disclosure of which is hereby incorporated by reference in its entirety.

BACKGROUND

The present disclosure generally relates to the field of exercise equipment. For example, aspects of the present disclosure relate to reformer devices and equipment configured to provide resistance training for various types of body exercises. Some reformer devices can be undesirably bulky, heavy, and expensive.

SUMMARY

Described herein are methods, systems, and devices that facilitate compound and/or full-body strength, stretching, and/or balance training, wherein spring(s) (e.g., resistance band(s)) and/or other features can be utilized to provide resistance against movement of a movable carriage or other member to exercise one or more muscles of the body.

Modular resistance-training and other exercise systems/equipment disclosed herein can comprise a glide module including a chassis, a sliding extremity platform configured to operate as a carriage/sled, and/or one or more resistance devices, such as resistance bands, configured to be coupled between a docking structure of the chassis and the sliding extremity platform. Such systems/equipment can further comprise an exercise bar module, which may comprise a base/stand configured to support an exercise bar, such as a balance bar or other bar having a horizontal crossbar component. The base/stand can include leg bases that provide standing support for the exercise bar module; the leg base(s) can include laterally/horizontally-extending support to provide added stability. The exercise bar module can include a fixed extremity platform (e.g., standing platform), which can provide a fixed extremity platform that, combined with the sliding extremity platform of the glide module, can facilitate resistance training. The glide module can be configured to mate with, or otherwise be disposed in physical coupling or proximity to, the exercise bar module to provide a resistance/reformer training assembly/system.

For purposes of summarizing the disclosure, certain aspects, advantages and novel features have been described. It is to be understood that not necessarily all such advantages may be achieved in accordance with any particular example. Thus, the disclosed examples may be carried out in a manner that achieves or optimizes one advantage or group of advantages as taught herein without necessarily achieving other advantages as may be taught or suggested herein.

BRIEF DESCRIPTION OF THE DRAWINGS

Various examples are depicted in the accompanying drawings for illustrative purposes and should in no way be interpreted as limiting the scope of the inventions. In addition, various features of different disclosed examples can be combined to form additional examples, which are part of this disclosure. Throughout the drawings, reference numbers may be reused to indicate correspondence between reference elements.

FIG. 3 shows an exercise system in a storage configuration in accordance with one or more embodiments.

FIGS. 9A and 9B top perspective and bottom perspective views, respectively, of a sliding carriage/plates in accordance with one or more embodiments.

DETAILED DESCRIPTION

Figure 1:
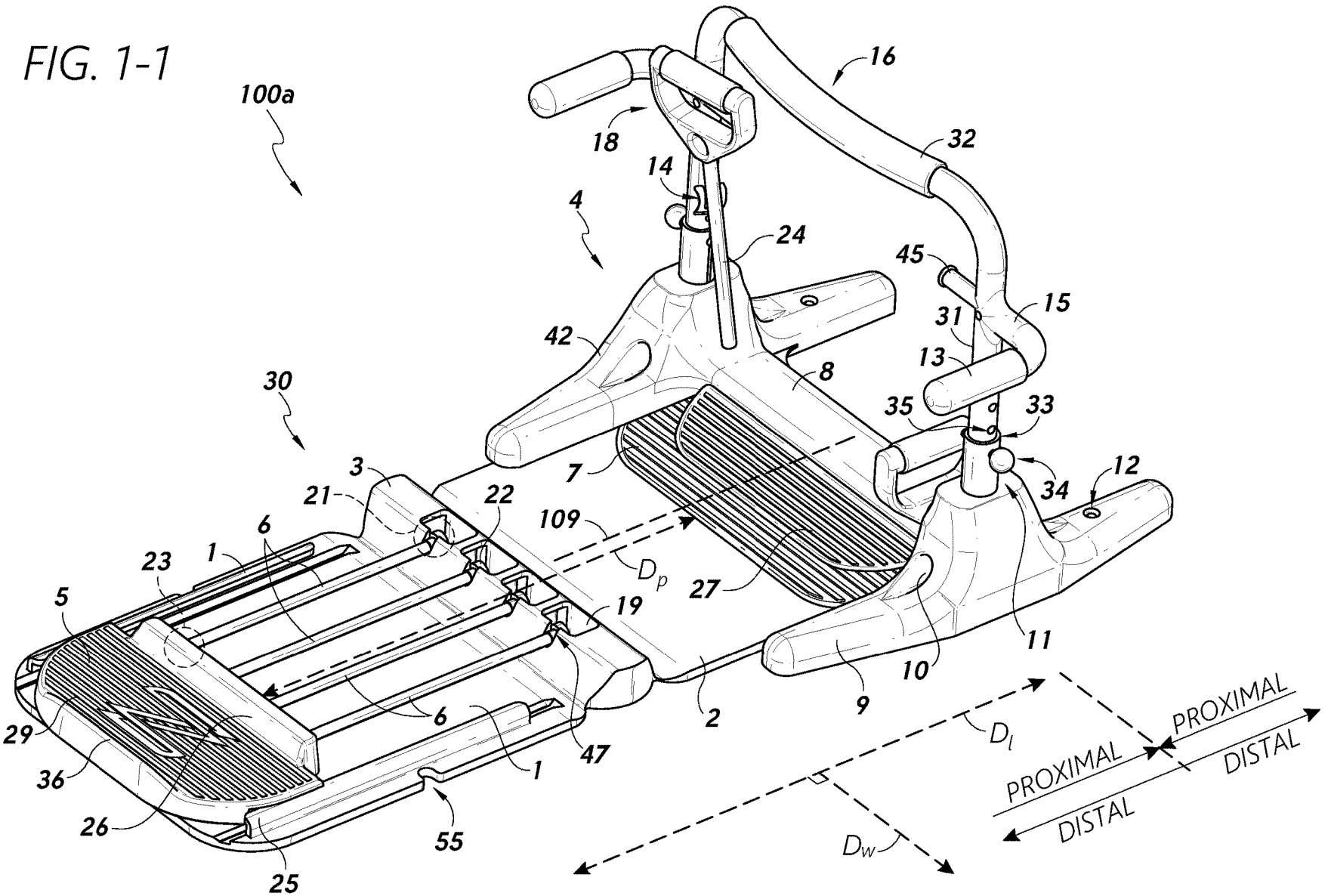
FIGS. 1-1, 1-2, and 1-3 illustrate modular exercise systems including sliding carriage components in accordance with one or more embodiments.

The headings provided herein are for convenience only and do not necessarily affect the scope or meaning of the claimed invention. Although certain preferred embodiments and examples are disclosed below, inventive subject matter extends beyond the specifically disclosed embodiments to other alternative embodiments and/or uses and to modifications and equivalents thereof. Thus, the scope of the claims that may arise herefrom is not limited by any of the particular embodiments described below. For example, in any method or process disclosed herein, the acts or operations of the method or process may be performed in any suitable sequence and are not necessarily limited to any particular disclosed sequence. Various operations may be described as multiple discrete operations in turn, in a manner that may be helpful in understanding certain embodiments;

however, the order of description should not be construed to imply that these operations are order dependent. Additionally, the structures, systems, and/or devices described herein may be embodied as integrated components or as separate components. For purposes of comparing various embodiments, certain aspects and advantages of these embodiments are described. Not necessarily all such aspects or advantages are achieved by any particular embodiment. Thus, for example, various embodiments may be carried out in a manner that achieves or optimizes one advantage or group of advantages as taught herein without necessarily achieving other aspects or advantages as may also be taught or suggested herein.

Certain reference numbers are re-used across different figures of the figure set of the present disclosure as a matter of convenience for devices, components, systems, features, and/or modules having features that are similar in one or more respects. However, with respect to any of the examples disclosed herein, re-use of common reference numbers in the drawings does not necessarily indicate that such features, devices, components, or modules are identical or similar. Rather, one having ordinary skill in the art may be informed by context with respect to the degree to which usage of common reference numbers can imply similarity between referenced subject matter. Use of a particular reference number in the context of the description of a particular figure can be understood to relate to the identified device, component, aspect, feature, module, or system in that particular figure, and not necessarily to any devices, components, aspects, features, modules, or systems identified by the same reference number in another figure. Furthermore, aspects of separate figures identified with common reference numbers can be interpreted to share characteristics or to be entirely independent of one another.

Where an alphanumeric reference identifier is used that comprises a numeric portion and an alphabetic portion (e.g., '10*a*.' '10' is the numeric portion and 'a' is the alphabetic portion), references in the written description to only the numeric portion (e.g., '10') may refer to any feature identified in the figures using such numeric portion (e.g., '10*a*,' '10*b*,' '10*c*.' etc.), even where such features are identified with reference identifiers that concatenate the numeric portion thereof with one or more alphabetic characters (e.g., 'a,' 'b,' 'c,' etc.). That is, a reference in the present written description to a feature '10' may be understood to refer to either an identified feature '10*a*' in a particular figure of the present disclosure or to an identifier '10' or '10*b*' in the same figure or another figure, as an example.

The present disclosure relates to personal exercise equipment, which may include one or more modular subsystems, and/or associated virtual reality and/or computer systems. Disclosed herein are various exercise systems, devices, and methods for personal strength training/exercise. Various exercise and/or fitness disciplines (e.g., yoga, Pilates, etc.) have grown extensively in popularity. While some embodiments are described herein in the context of yoga and/or Pilates exercises, it should be understood that any of the embodiments disclosed herein can be used for, or relate to, any other suitable or desirable type of exercise and/or fitness discipline.

Yoga and Pilates can provide many health benefits, particularly for those suffering from back pain and/or other conditions. Yoga and Pilates have shown to have a number of different health benefits for both physical and mental wellbeing. Some embodiments disclosed herein provide a yoga and/or Pilates exercise system/device that is usable as a metaverse (e.g., virtual reality) gym and/or exercise platform combining various/multiple categories of exercise with metaverse (e.g., virtual reality, augmented reality, internet-of-things, artificial intelligence, blockchain, and/or the like) features, which can advantageously provide an immersive experience for a user, further promoting health. Such metaverse environment may be interactive and/or instructional and/or can include exercise gaming with other users. Visual metrics can be displayed, for example speed, distance, duration, repetitions, resistance, and/or sets.

Metaverse-integrated exercise platforms disclosed herein can provide a virtual reality (VR) environment that includes artificial intelligence (AI) evaluation. For example, as a user exercises, an AI engine can continuously evaluate and/or compare the user's workouts and/or body metrics to determine progress and/or can automatically make changes to a user's workout routine by decreasing and/or increasing sets, repetitions, resistance, and/or duration. Systems disclosed herein can include one or more electronic displays, such as televisions, monitors, tablets, VR headsets, augmented reality (AR) glasses, and/or phones inserted into a VR viewer associated with the exercise platform. Such exercise platforms can include a means for scanning body movements and representing and/or overlaying user images/representations in a virtual environment. For example, exercise platforms described herein can incorporate AI motion sensors using certain control circuitry (e.g., integrated in smartphone and/or laptop computing devices), and can use 2D and/or 3D marker-less motion tracking of a user's movements to generate metrics including reps, form, position, angles, and other biomechanical feedback. The exercise platforms/systems can implement various other metrics that can be securely stored (e.g., in remote/cloud data storage), that can include, for example, health data, anti-aging metrics, body and personal data metrics, workout and physical activity data along with biomechanical analysis and feedback.

Some embodiments disclosed herein can provide various benefits, including simplified devices for strengthening core muscles, improving overall body posture, relieving joint pain and/or muscle pull, body toning, and/or increased flexibility and/or balance. Pilates reformer devices/systems disclose herein can be used to perform exercises that stimulate muscles without requiring substantial cardiovascular exercise or weightlifting. Embodiments disclosed herein can be used to help tone the body, develop core muscles, and/or reduce joint discomfort and muscle tension.

Exercise platforms disclosed herein can be used to perform various exercises including upper body arm, shoulder, chest, back, triceps, bicep, lats, and/or other muscle groups using various resistance bands and/or positions on the exercise platform. Systems disclosed herein can further allow users to perform approximately twenty or more lower body exercises that can be done with resistance for strength training and/or toning the glutes, calves, thighs, glutes, stomach, hamstrings, and other lower body muscles. Lunges, squats, leg presses, twists, side stepping, lateral raise, calf raise, and many other exercises can be performed using any of the embodiments disclosed herein.

Modular Reformer Systems/Devices

Figures 1, 2:
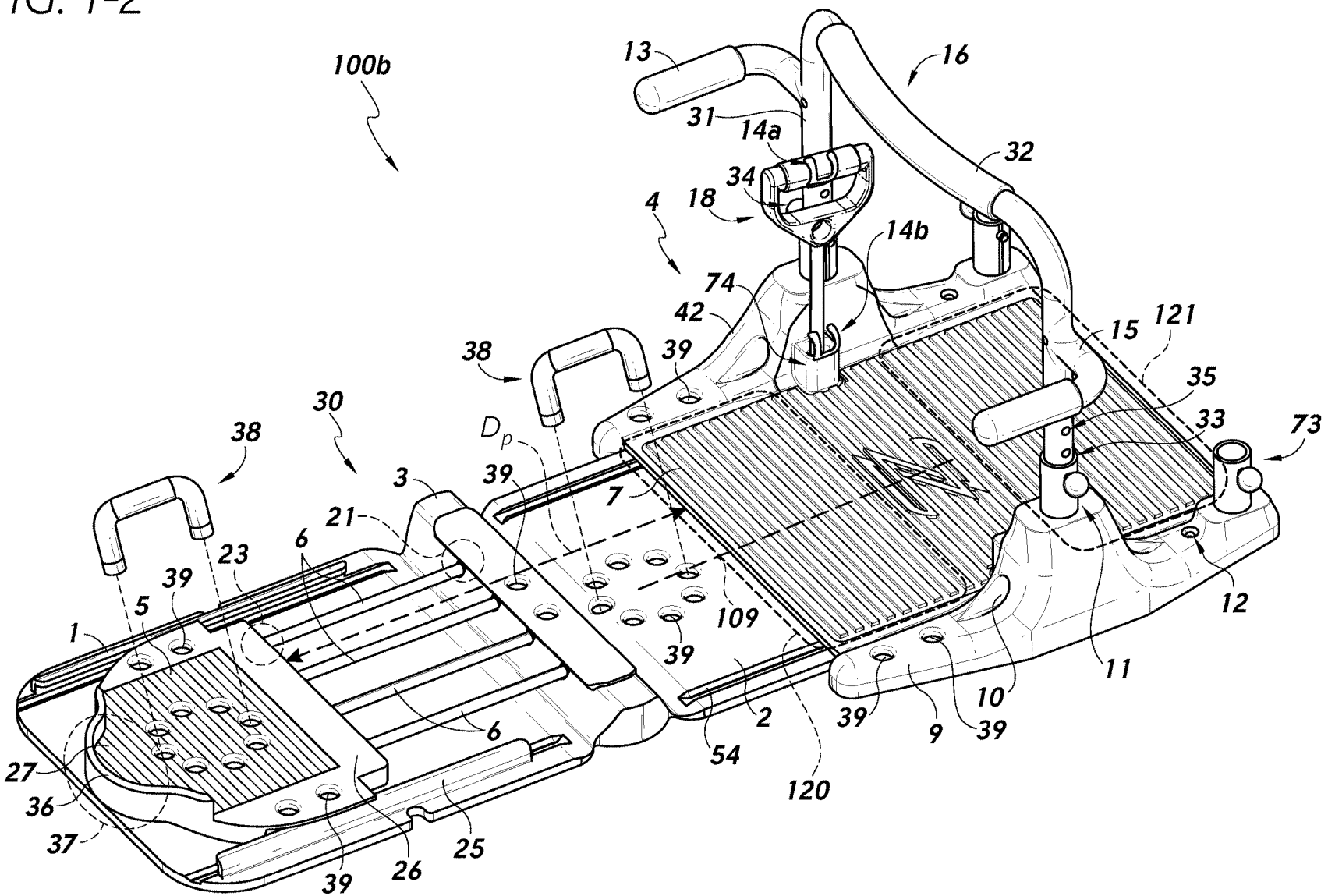
Figures 1, 2, 3:
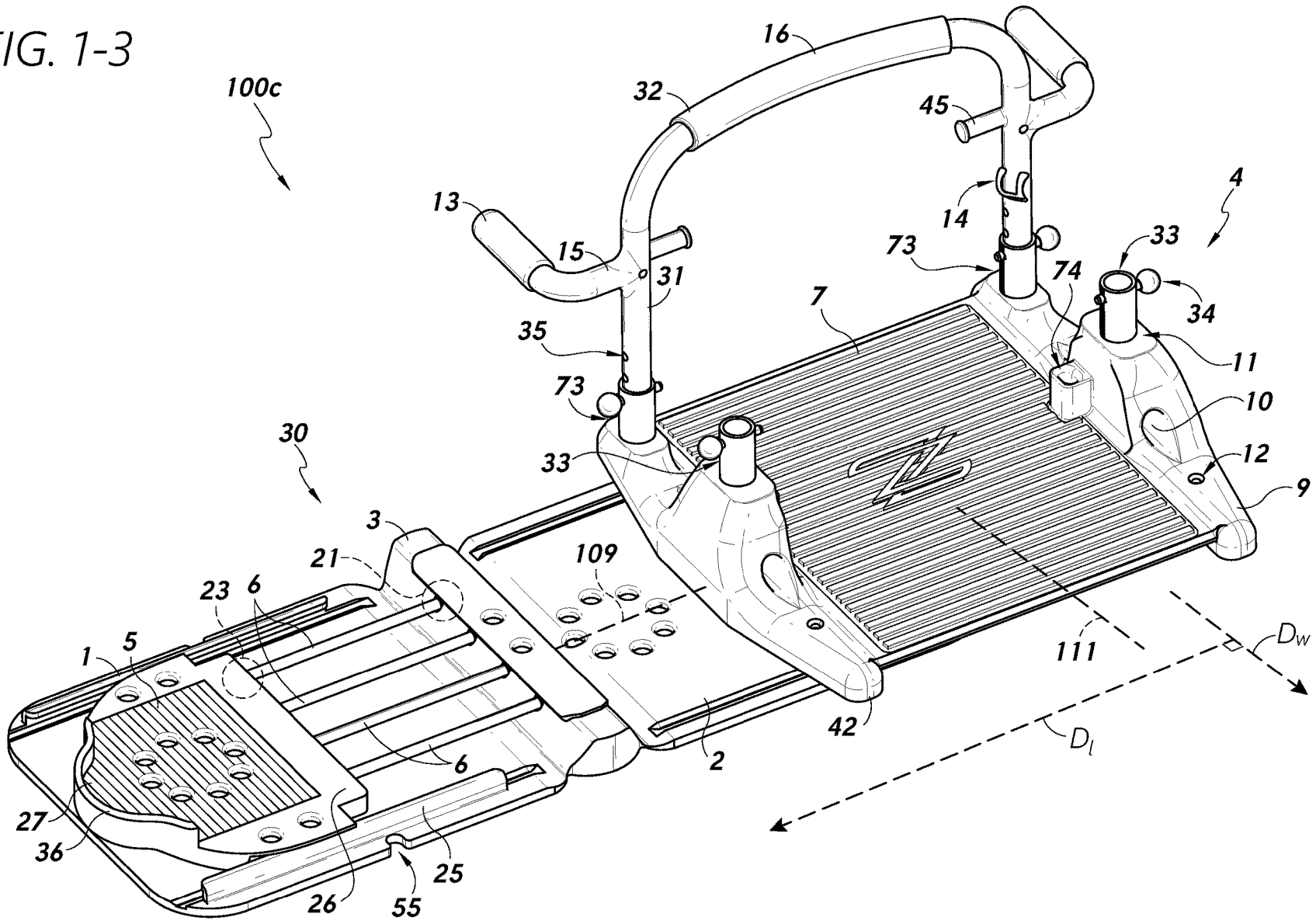

FIGS. 1-1, 1-2, and 1-3 illustrate example embodiments and configurations of a modular reformer system 100 in accordance with aspects of the present disclosure. Although particular aspects of the systems 100 illustrated in FIGS. 1-1, 1-2, and 1-3 can vary in one or more respects from one another, for convenience and clarity, the description below can be understood to relate to any of the systems 100*a*, 100*b*, 100*c*, and references to a reference identifier that is used in more than one of FIG. 1-1, 1-2, or 1-3 can be understood to relate to such identified components in any of the relevant ones of FIG. 1-1, 1-2, or 1-3. Furthermore, description of the reformer system '100' can be understood to refer to any of the reformer systems 100*a*, 100*b*, or 100*c*. Any subset of the components shown in any of FIGS. 1-1-1-3, or any of the other figures provided herewith, can be combined/provided in a kit, such as in one or more boxes, wherein the components of the kit may be assembled/combined in some manner by the user.

The reformer system 100 may comprise a gliding platform module/unit 30 including one or more platforms, which may have the form of segmented support boards. For example, the glide module/unit 30 can include a first board/platform/panel 1 and/or a second board/platform/panel 2. The first board/panel 1 and the second board/panel 2 may be interconnected by a resistance band/device docking segment 3, which may have the form of a raised hub structure. The dock 3 may have a ridge/curb/flange form that has a lengthwise dimension that is transverse-oriented with respect to a lengthwise dimension $D_l$ of the module 30 and/or system 100. For example, the dock 3 may have an elongate shape that runs perpendicular to the lengthwise dimension $D_l$ of the system 100 (i.e., parallel with the widthwise dimension $D_w$ of the system 100). The dock/hub 3 may serve as, and/or be considered, a partition, interface, divider, console, dock, docking station, or the like, and may comprise one or more wells, slots, channels, grooves, anchor points, or compartments 19 configured to receive and/or anchor/secure portions (e.g., proximal anchor/docking ends/portions) of one or more resistance devices 6 (e.g., bands).

The resistance devices 6 are described as bands in the description below, although it should be understood that the resistance devices shown and described in connection with the present disclosure 6 may have any suitable or desirable configuration or structure. The resistance bands 6 may be coupled at a first end 21 (e.g., 'proximal' end) thereof to the dock 3, as shown, which can advantageously provide a static/stationary base for the resistance bands 6. For example, anchors/ends 22 associated with the first end 21 of the resistance bands 6 can be inserted into and/or otherwise coupled with the openings/wells 19 of the dock 3 and held/secured therein. The terms "associated" and "associated with" are used herein according to their broad and ordinary meanings. For example, where a first feature, element, component, device, or member is described as being "associated with" a second feature, element, component, device, or member, such description should be understood as indicating that the first feature, element, component, device, or member is physically coupled, attached, or connected to, integrated with, embedded at least partially within, or otherwise physically related to the second feature, element, component, device, or member, whether directly or indirectly. The anchor wells 19 may be any type of receptacle or cavity access for placement of resistance band portions.

Second ends 23 (e.g., 'distal' ends) of the one or more resistance devices/bands 6 may be connected to a sliding touchpoint (e.g., foot) plate/platform 5. The sliding foot plate 5 may provide a dynamic/movable component that, when coupled via spring/resistance devices/bands 6 to the stationary dock 3, provides a resistive sliding carriage for resistance training. In combination with other resistive features of the system 100, such as the resistance bands/devices 24, the system 100 allows for simultaneous upper and lower body resistance training.

The first glide panel/board 1 and the sliding foot plate 5 can operate as a linear guide/rail system, where the foot plate 5 can move as a carriage/slide/runner in a single dimension Di along a rail. The panel/board 1 can include a track 25 running along one or both sides of the platform 1, which includes structure along which the foot plate 5 can move. Although certain images and description herein relate to liner guiderails/tracks that run along one or both sides of a board/panel, it should be understood that such rails/guides can run along a center line 109 or other position of the respective board/panel. The board/panel 1 can operate as a linear slide table with the foot plate 5. The track 25 can provide a linear bearing for the movement of the plate/platform 5. The platform 1 The foot plate can comprise any structure to slidingly interface with the track 25, such as a t-slot extension configured to be disposed within, and retained by, a channel of the track 25.

The foot plate 5 can comprise a proximal flange 26, which may provide a stopper, bumper, cushion, or the like that a user's foot may contact to provide support when exercising. The proximal end/portion 26 of the plate 5 can further provide docking features for coupling distal ends/portions 23 of the resistance bands 6 to the plate/platform 5. In addition, the surface of the foot plate 5 may comprise traction features 27, such as a mat, pad, or surface comprising one or more treads, ridges, grooves, or the like, which can provide traction for the user's foot (or hand). In addition to, or as an alternative to, the proximal stopper flange 26, the foot plate 5 may include a distal stopper flange/lip 36, which may allow the user to apply lateral force to the foot plate 5 in the longitudinal dimension $D_l$ to thereby cause the resistance bands 6 to expand/stretch to permit the foot plate 5 to slide in the distal direction. The distal stopper 36 may have a generally straight form, as shown in FIG. 1-1, or may be curved, as shown in FIG. 1-2. The curvature of the flange 36, which can be outwardly-convex/inwardly-concave, as shown in FIG. 1-2, can conform at least in part to the shape of the user's foot to allow for positioning of the foot within the distal portion 37 of the foot plate 5 defined by the distal flange 36.

The system 100 may comprise a base structure 4, which may serve as an exercise bar stand, and therefore may be considered a bar-support base or stand. For example, the base/stand 4 may be configured to support an exercise/balance bar 16 and/or other component(s) of the system 100. The base/stand 4 may comprise a fixed foot/standing platform/plate 7, and may be physically coupled/secured to the second board/panel 2 of the glide module/unit 30 (or to another component of the glide unit 30, such as the dock/hub 3). The base/stand 4 can include a foot stop 8 and/or traction features 27. The base/stand 4 can include lateral stabilizers 9 that run along the lengthwise dimension $D_l$ to provide stability for the base/stand 4 and system 100. The stabilizers 9 can have the form of any type of foot, footing, spreader, outrigger, or the like. The glide unit 30 may advantageously comprise a foldable, dual-board chassis, wherein flexing the boards (e.g., at/near bases thereof) can be implemented to transition the chassis between folded/stowed and open configurations.

As shown in FIG. 1-2, the second panel/board 2 of the glide unit 30 can have circular holes 39, or other types of mating receptacles, to allow for exercise handles 38 (e.g., push-up handles) to be placed in various angles. For example, the mating holes/receptacles 39 may be arranged in a circular patterns, as shown. When exercising, a user may hold/use an exercise handle 38 mounted to certain ones of the mating holes 39 with one hand while performing resistance gliding/movement on/with another hand positioned on the sliding plate/carriage 5. The legs/stabilizers 9 can likewise include mating holes/receptacles 33/10 for the attachment of the exercise/balance bar 16 and/or for channeling/passage of resistance bands 24.

The base/stand 4 supports and/or includes the exercise (e.g., balance) bar 16. For example, the bar 16 may be integrated with and/or secured to the base 4 in some manner via exercise bar docks 11, which may comprise one or more mounting sockets or receptacles 33, which may include a height-adjustment means or mechanism for selectively setting the height of the bar 16. For example, the bar 16 may include vertical pole segments 31 and a crossbar segment 32, wherein the height of the crossbar segment 32 may be adjustable by adjusting the coupling of the vertical bar segments 31 with the base 4. In some implementations, height adjustment is implemented through the use of a pin-and-hole adjustment system, where a pin 34 may be inserted through the bracket 33 and through corresponding apertures 35 in the vertical portions 31 of the balance bar 16. Such mechanism may allow the user to select the desired height for the crossbar portion 32 of the balance bar 16 that corresponds to the particular workout and/or the height of the user, wherein the height setting of the bar 16 can be secured in place using the pin 34.

The balance bar 16 can be curved in the lengthwise dimension $D_l$ to some degree, which may provide a more ergonomic presentation for manual holding by the user. The system 100 may further comprise one or more receptacles 12 for storing the bar height fixing pin(s) 34 when not in use, such as for when the bar 16 4 is placed in a storage position in the lateral docks/receptacles 10. In some examples, such as is shown in FIG. 1-2, the base/stand 4 includes secondary vertical bar mounting brackets/docks 73, which may be positioned on the lateral stabilizers(s) 9, such as at an end portion/area thereof.

The system 100 can further include one or more (e.g., two, as shown) handled resistance bands/devices, including band 24 and handle 18 portions/components, which may be secured to the base/stand 4 in a position laterally outside of the center 109, and/or advantageously laterally outside of the area of the footpad/plate 27. In some implementations, handle clips 14 can be coupled to and/or otherwise associated with the vertical portion(s) 31 of the exercise bar 16, wherein the clip(s) 14 can include hooks or other similar features configured to secure/hold the handle portion 18 of the handled resistance bands. Therefore, when not being used by the user, the resistance band handles 18 may be secured to the base/stand 4 and/or bar 16 in a position as to not interfere with the exercise activity of the user and/or in a position that is suitable for storage of the system 100. In some implementations, the clip(s) 14 for the resistance band handles 18 may be disposed below the balance bar 16 in an area closer to the floor contact of the base/stand 4. For example, FIG. 1-2 shows the example lower resistance band handle clips 14*b*, as well as optional higher clips 14*a*.

The balance bar 16, in addition to the crossbar 32, may include one or more additional handles 13. For example, whereas the crossbar 32 may generally be oriented in the widthwise dimension $D_w$, the manual handles 13 may be oriented in the lengthwise dimension $D_l$ in some embodiments. As an example, the secondary handles 13 may project from the vertical portions 31 of the balance bar 16. In some implementations, as shown, the secondary handlebars 13 may project from the balance bar 16 first in the widthwise dimension $D_w$, and may curve towards the lengthwise dimension $D_l$, as shown. As with any handle of the system 100, the handles 13 may include grip foam or tape, or similar features to promote grip and/or comfort when manually engaged by the user.

As described in detail herein, the system may provide an exercise assembly for allowing a user to dynamically move/extend lower body parts, such as the feet and legs, through standing on the dynamic (e.g., sled/carriage 5) and/or static (e.g., platform 7) extremity-support (e.g., foot) plates/platforms of the system 100 and engaging the resistance bands 6 to slide the sliding sled/carriage (e.g., foot plate) 5 through foot contact, thereby increasing and decreasing the relative distance $D_p$ between the foot sled/carriage 5 and the static standing platform 7. However, it should be understood that the system 100 may be configured to allow for various upper-body exercises through engagement with the sliding plate/platform 5 by placing hand(s), forearm(s), elbow(s), or other upper-body member(s) on one or more of the platforms 5, 2, 7, or by using/engaging upper-body-targeted tools, such as push-up bars or the like. For example, the system 100 may include docks, holes, or other types of receptacles 39 for coupling push-up handle bars 38, or similar manually-engageable devices.

Handle-mating holes/receptacles 39 may be implemented in the sliding plate 5, the glide module/unit hub/dock 3, the stationary plate 2, the balance bar leg base(s) 42, such as in the lateral/horizontal stabilizer(s) 9, or any other component of the system. For example, a user may couple a first exercise/manual handle 38 (e.g., push-up bar/handle) with handle-mating holes 39 associated with the sliding plate 5, and may further couple a second exercise/manual handle 38 to one of the static components of the system 100, such as the surface of the other static panel 2 of the glide module 30, the dock/hub 3, and/or the leg base(s) 42. Example positions for such handle-coupling holes/receptacles 39 are shown in FIG. 1-2. In some implementations, markings may be implemented in the area(s) of the manual handle-mating holes/receptacles 39 to indicate visually optional positions for push-up handles, or other devices, to aid the user in configuring the handles 38 for certain exercises. The handle-mating docks/holes 39, with handle(s) 38 coupled thereto, can be placed in various positions to be used for push-up exercises and/or to be used with the glide platform for sliding, e.g., Pilates, resistance/reformer exercises. Any of the platforms of the system 100, which may be considered foot bars (e.g., particularly the resistance-movable platform 5), can be configured to be convertible into use as a handle bar member, for any standing, kneeling, lying (as on stomach or side), seated, or other exercise positions, with or without the use of a raised platform.

The system 100 may further comprise one or more side handles 15 associated with the exercise/balance bar 16. The one or more side handles 15 may comprise pads 13. The side handles 15 of the balance bar 16 can be used in a different grip exercises, allowing for user to grip in a side, hand grip position.

One or more resistance band handle clips 14 may be associated/coupled with the exercise/balance bar 16 and configured to receive one or more resistance band handles 18. The resistance band handle storage clip(s) 14 can provide dock(s) for placement of the handle(s) 18 when not being used for exercise. The system 100 may comprise upper 14*a* and/or lower 14*b* resistance band handle storage docks configured to receive one or more resistance handles 18. The resistance band handles 18 can have grip cushion features to allow users to grip and perform multiple exercises. The bar 16 can further include inner pegs/mounts 45 for mounting a resistance band handle or other equipment.

The peg(s)/mount(s) 45 can be vertically in-line with the secondary side handles 15, as shown, or at another elevation relative to the vertical portions 31 of the handle 16. The peg(s)/mount(s) 45 can be straight and horizontally-oriented, as shown, and may have end caps/flanges to retain a mounted handle or other piece of equipment.

In some implementations, as shown in FIG. 1-2, the standing platform 7 may include a first area 120 on a first side of the crossbar 32, which side may correspond to the side of the stand/base 4 into which the board 2 may be inserted or otherwise engaged. A second area 121 of the standing platform 7 may be positioned/accessible on an opposite side of the crossbar 32.

FIG. 1-3 shows the system 100*c* in an alternate configuration in which the exercise bar base/stand 4 is positioned such that the crossbar 32 runs generally in the lengthwise dimension $D_l$ of the system 100*c*, with the centerline 111 of the standing platform 7 running in the widthwise dimension/direction $D_w$. In such configuration, it may be desirable for the exercise bar 16 to be docked/positioned in the side dock(s)/mount(s) 73, so as to not obstruct the center of the standing platform 7, which may be positioned in the area of the centerline 109 of the system 100*c*.

In the configuration of the system 100*c*, the user may exercise using the crossbar grip 32 or the side handle grips 13, which provide another angle and grip point to use for balance and various exercises. By providing the ability to rotate the exercise bar base/stand 4, thereby rotating the fixed foot plate/platform 7, by, e.g., 90°, as shown, the system 100 allows for a variety of exercises at different angles and directions using the same modular components and system. Such configurability can enable a user to work out in different planes or vectors of motion, and can improve the flow of any exercise class by having this increased functionality on a single apparatus. The system configurability can also enable a user to perform a greater variety of exercises to exercise a greater variety of muscle groups.

Figure 2A:
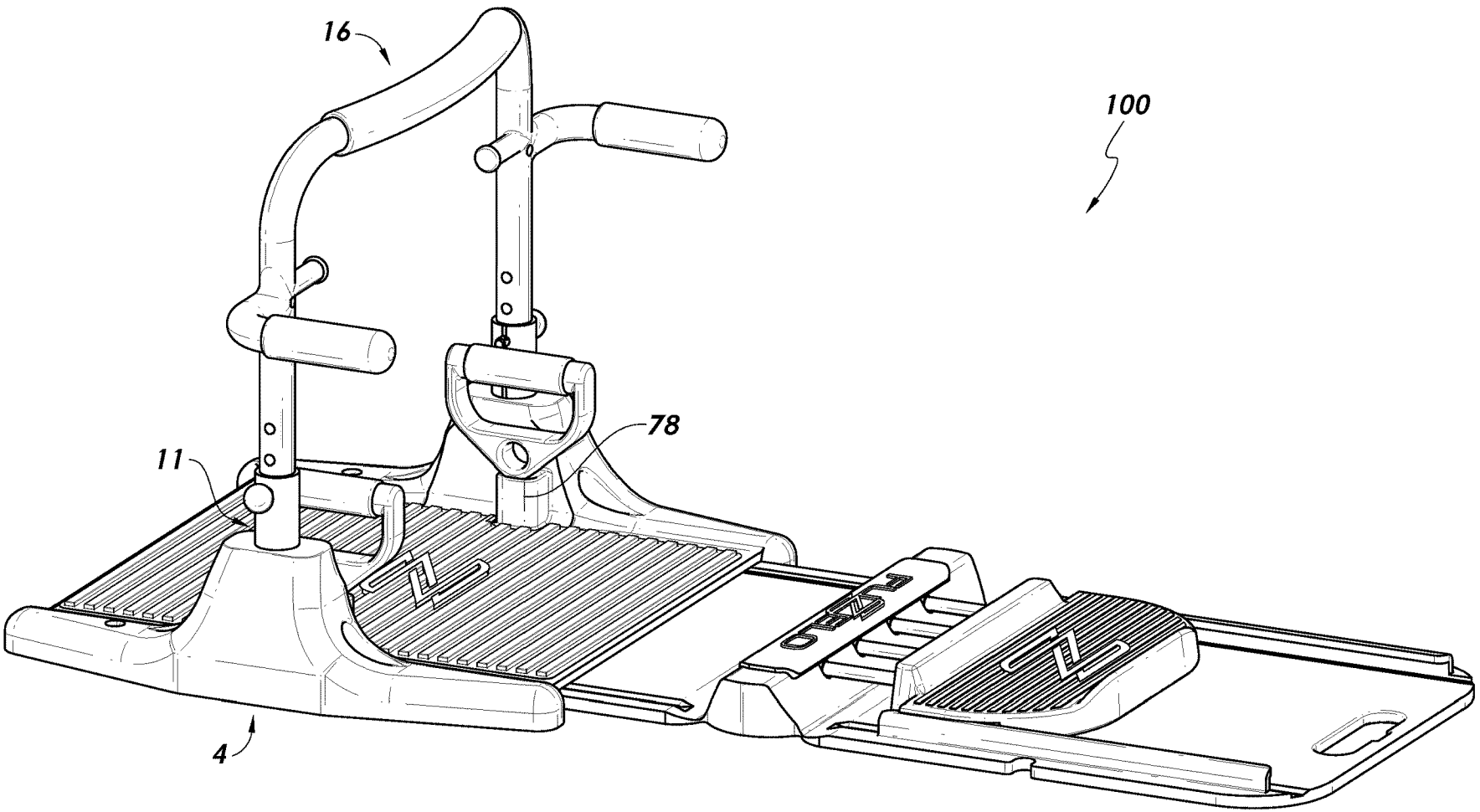
FIGS. 2A-2C show perspective, side, and top views, respectively, of a modular exercise system in accordance with one or more embodiments.
Figure 2B:
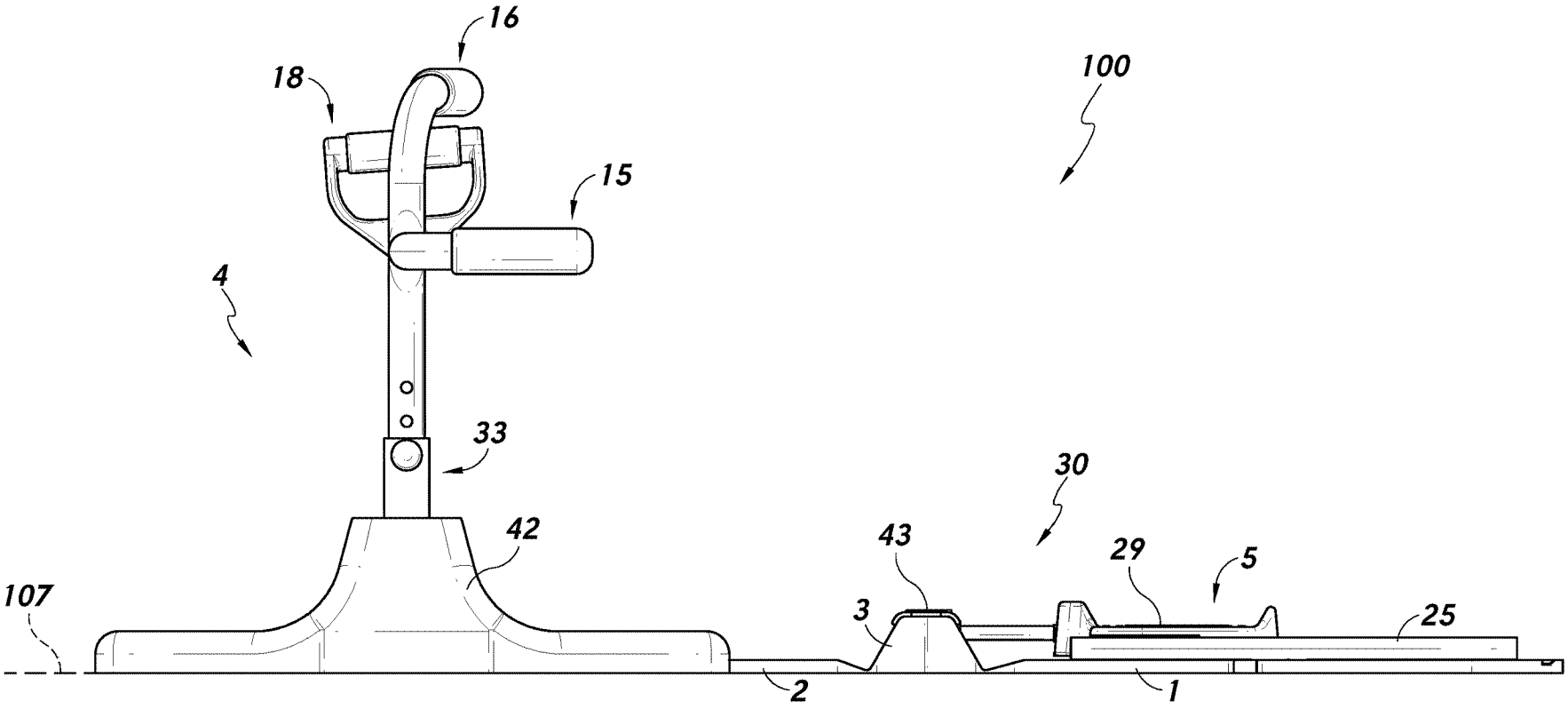
Figure 2C:
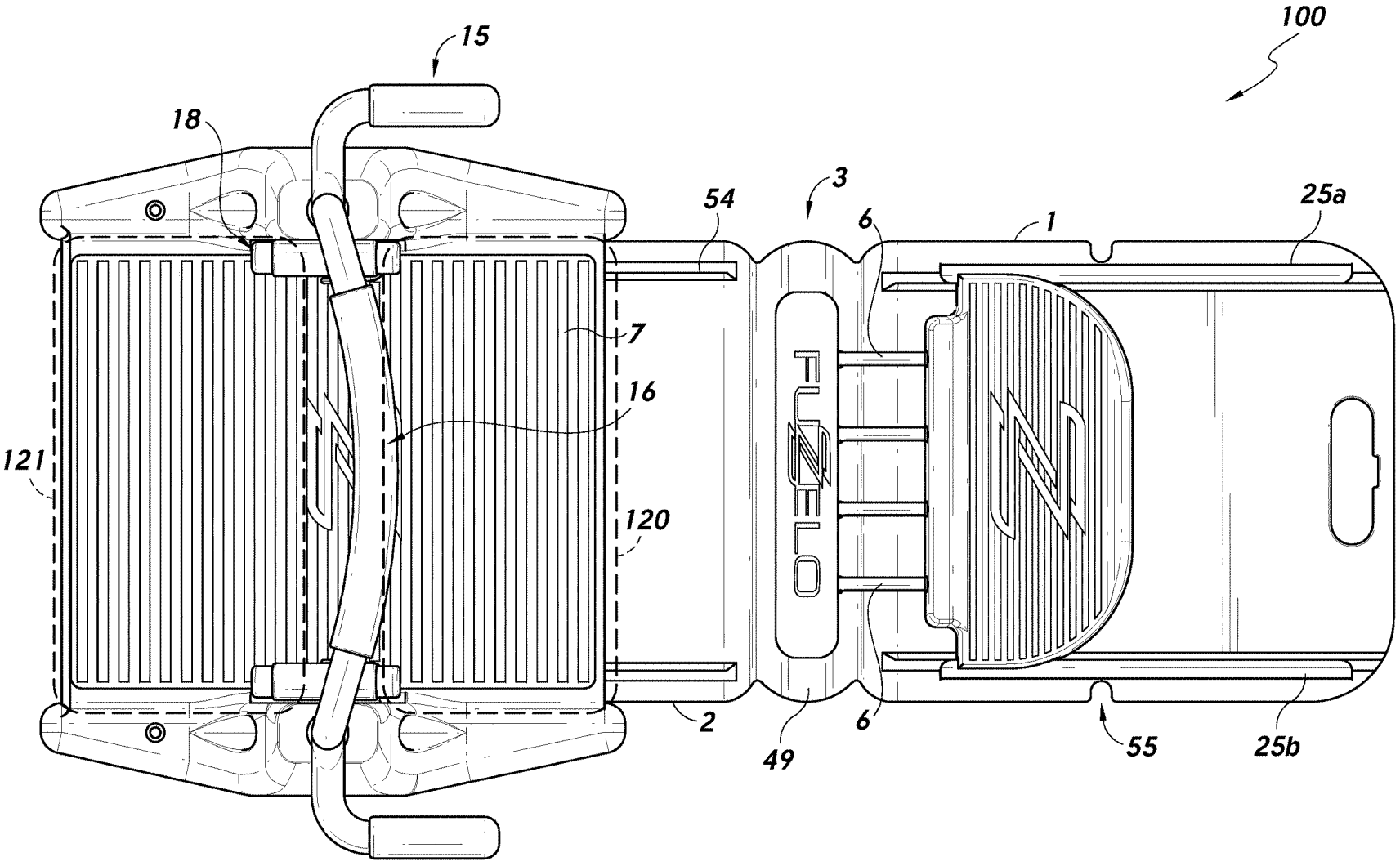

FIGS. 2A-2C show perspective, side, and top views, respectively, of various configurations of the modular reformer exercise system 100 in accordance with one or more embodiments of the present disclosure. The system 100 includes the glide module 30, which may be separable from the exercise stand/base 4. The glide module 30 can comprise a frame/chassis including a first board/panel 1 and a second board/panel 2, separated by a transverse-oriented resistance band dock 3. The first board/panel 1 can have two horizontal frame/track members 25*a*, 25*b* extending along sides of the board/panel 1.

A carriage 5 is supported by the horizontal frame/track members 25, the carriage 5 being configured to translate along at least a portion of a length of the horizontal frame/track members 25 and having a planar support surface 29. A first set of springs 6 is supported by, and/or coupled to, the carriage 5, wherein the first set of springs 6 (e.g., resistance bands) are configured to extend toward a proximal end of the first panel/board 1 to a connection with the docking structure 3. The docking structure 3 can have a raised top surface 49 that lies in a plane above a top surface 29 of the glide carriage 5 and can be configured to support a user in a seated position. Alternatively, the fixed platform 7 can be used by the user as a sitting platform in some exercises.

Figure 2D:
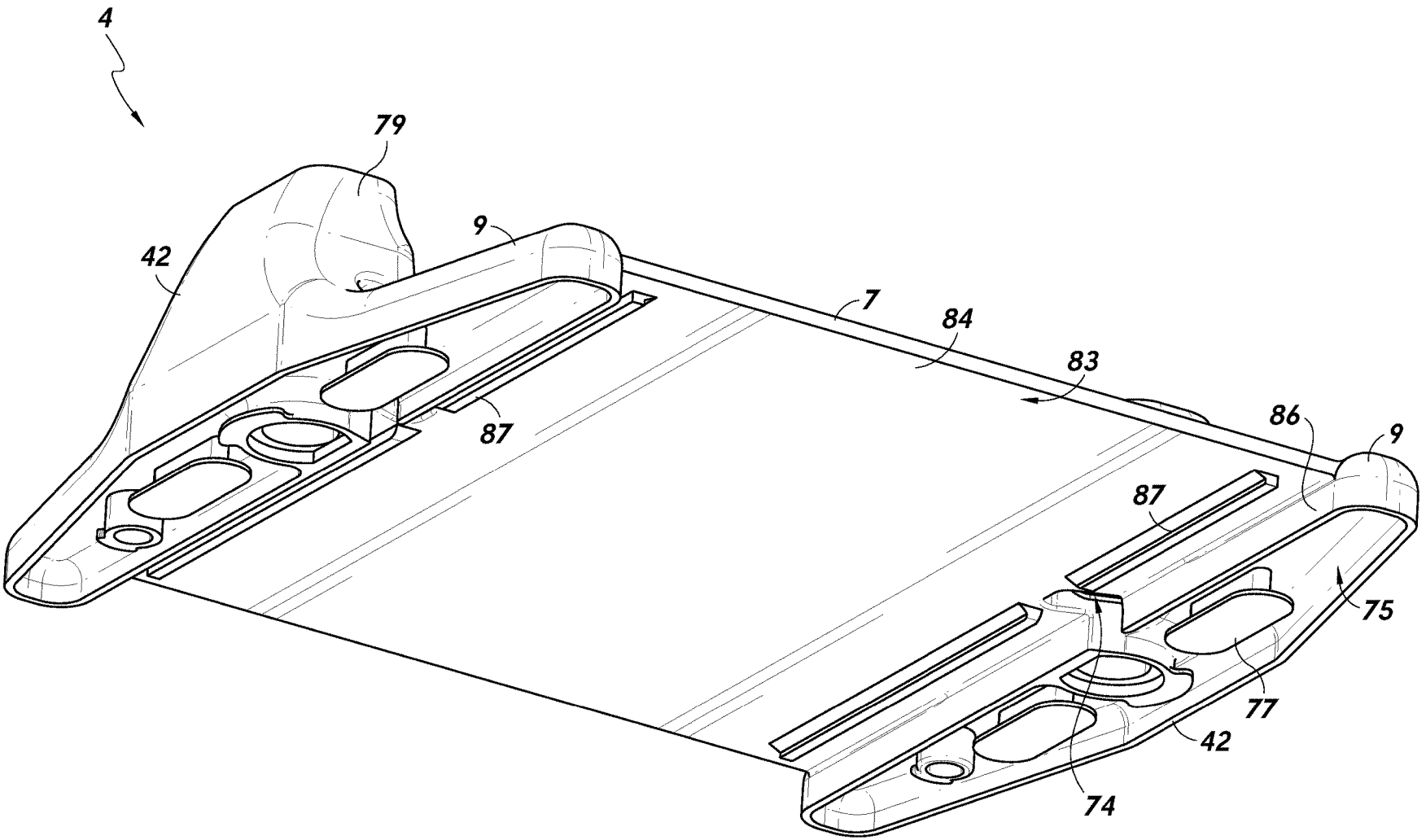
FIG. 2D shows an underside view of an exercise bar base in accordance with one or more embodiments.
Figure 3:
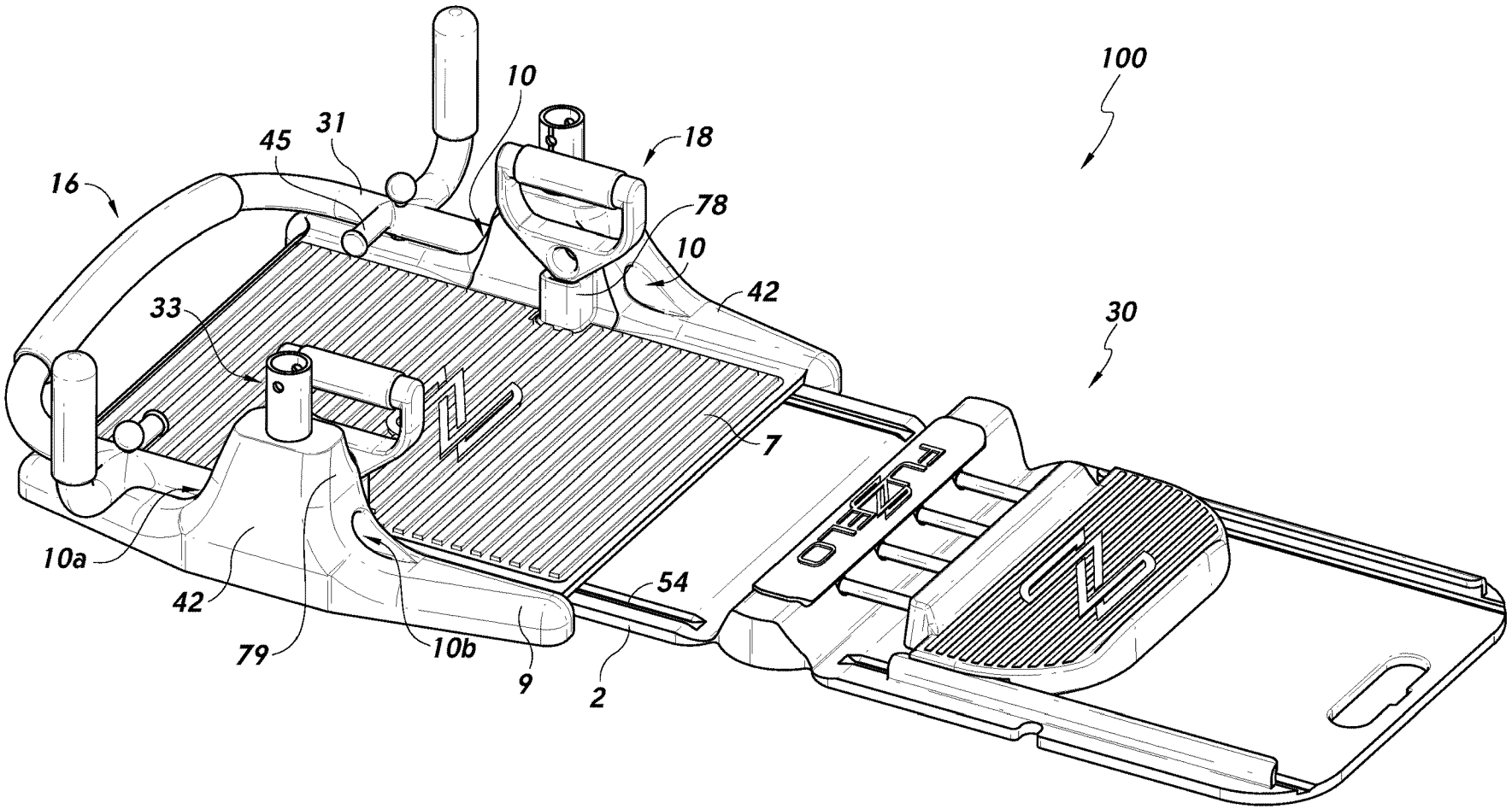

FIG. 2D shows a bottom view of a balance bar base/stand 4. The base/stand 4 may be configured with resistance band storage and/or routing cavities, brackets, and/or channels. For example, the standing platform 7 and/or leg base(s) 42 can have channels 74 (e.g., vertical channels) through which resistance band(s) 24 can pass, wherein the resistance band (s) 24 can be coupled/secured at ends/portions thereof within a storage cavity/space 75 within the leg base form(s) 42, such as at least partially within the lateral stabilizer portions 9 of the leg base(s) 42. The base(s) 42 can further include mounting structures 77, such as spool-type projections, around which a resistance band can be wrapped and/or secured. The resistance bands 24 can be housed at least partially within the under carriage of the stand/base 4 shown in FIG. 3D. The detachable disposition of the bands through/in the stand/base structure 4 can facilitate swapping-out of different types of resistance bands, thereby providing customizability/adjustment of the resistance characteristics of the system 100.

The underside 84 of the fixed platform 7 can be raised above a floor-contact plane 107 of the leg bases 42, such that when the base/stand 4 is placed on a generally flat surface, the underside 84 of the platform 7 and the inside walls 86 of the leg bases 42 define an open channel/space 83 (e.g., generally rectangular volume) between the platform surface 84, sidewalls 86, and the surface on which the base/stand 4 is place (e.g., ground). Such space 83 can be configured/dimensioned to receive at least a portion of the proximal boar/panel 2 of the glide module 30. In some implementations, the platform 7 includes groove/channel features 87, such as male tongue/groove flanges/projections that are configured to fit within corresponding channels 54 of the board/panel 2 to guide insertion of the board/panel 2 into the space 83 under the standing platform 7. Although male mating features 87 are shown on the underside 84 of the standing platform 7 and corresponding female mating features 54 are shown on the glide module panel/board 2, it should be understood that the feature 54 of the panel/board may be male features and the features 87 of the platform 7 female features in some implementations.

FIG. 3 shows a perspective and front-side view of the exercise system 100 with the exercise/balance bar 16 component thereof disposed in a storage position/configuration. In the assembled configuration of FIGS. 1-1-1-3 and FIGS. 2A-2C, the balance bar 16 is shown in a vertical configuration appropriate for exercise used by the user. The system 100, as described herein, may advantageously be designed to facilitate relatively low-profile storage of the system 100 when not in use. For such purposes, the system 100 may include exercise bar storage features 10, which may comprise receptacles, recesses, channels, sockets, docks or the like. Such bar storage receptacles 10 may advantageously be disposed/positioned relatively close to the bottom/floor-contact of the base 4, as shown, and may be oriented to hold the balance bar 16 in a horizontal orientation, generally perpendicular to the vertical orientation shown in certain other figures. The exercise bar storage receptacles 10 may be positioned laterally outside of the fixed foot plate/platform 7 in the form of the leg base 42 of the base/stand structure 4. The leg base 42 may be configured with receptacles 10*a* that allow for insertion of the vertical portions 31 of the bar 16 from the back side (as shown in FIG. 3), or receptacles 10*b* that allow for insertion from the front side, or both. For example, the storage receptacles 10 may pass entirely through the vertical portion 79 of the leg base(s) 42. The storage receptacles 10, which can comprise any type of male or female engagement features, can allow for the bar 16 to be placed therein and locked, allowing for the unit to be hung by the bar 16 or stored under a piece of furniture.

In the storage configuration shown in FIG. 3, the resistance bar handles 18 may be held against resistance band ports 78, which provide access to channels 74 through the platform 7 and/or leg base(s) 42 for positioning of the resistance band(s) 24 on the underside of, and/or within, the leg base(s) 42.

Figure 4:
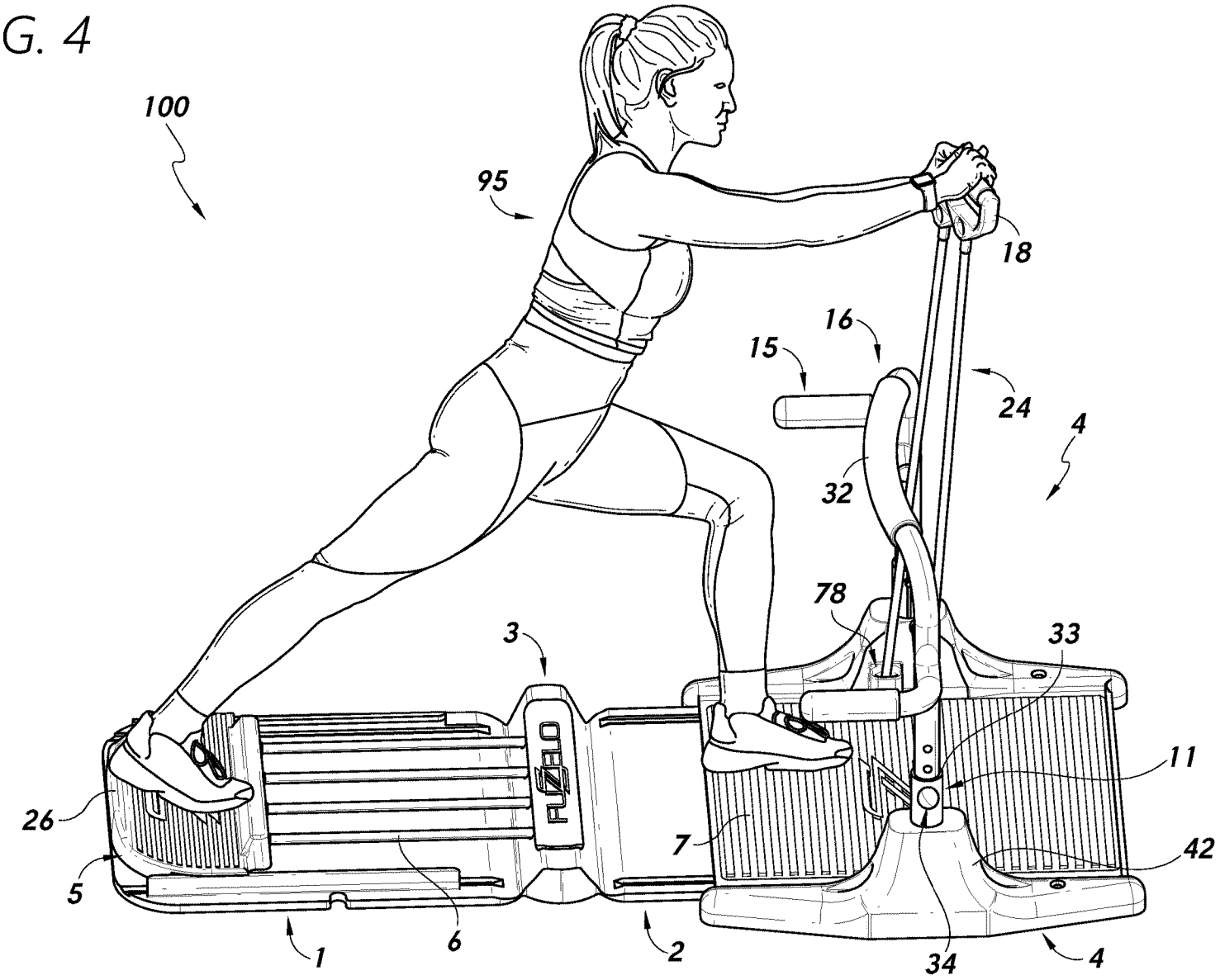
FIG. 4 shows a user utilizing an exercise system in accordance with the present disclosure with a balance bar component of the system in a lowered position/configuration in accordance with one or more embodiments.
Figure 5:
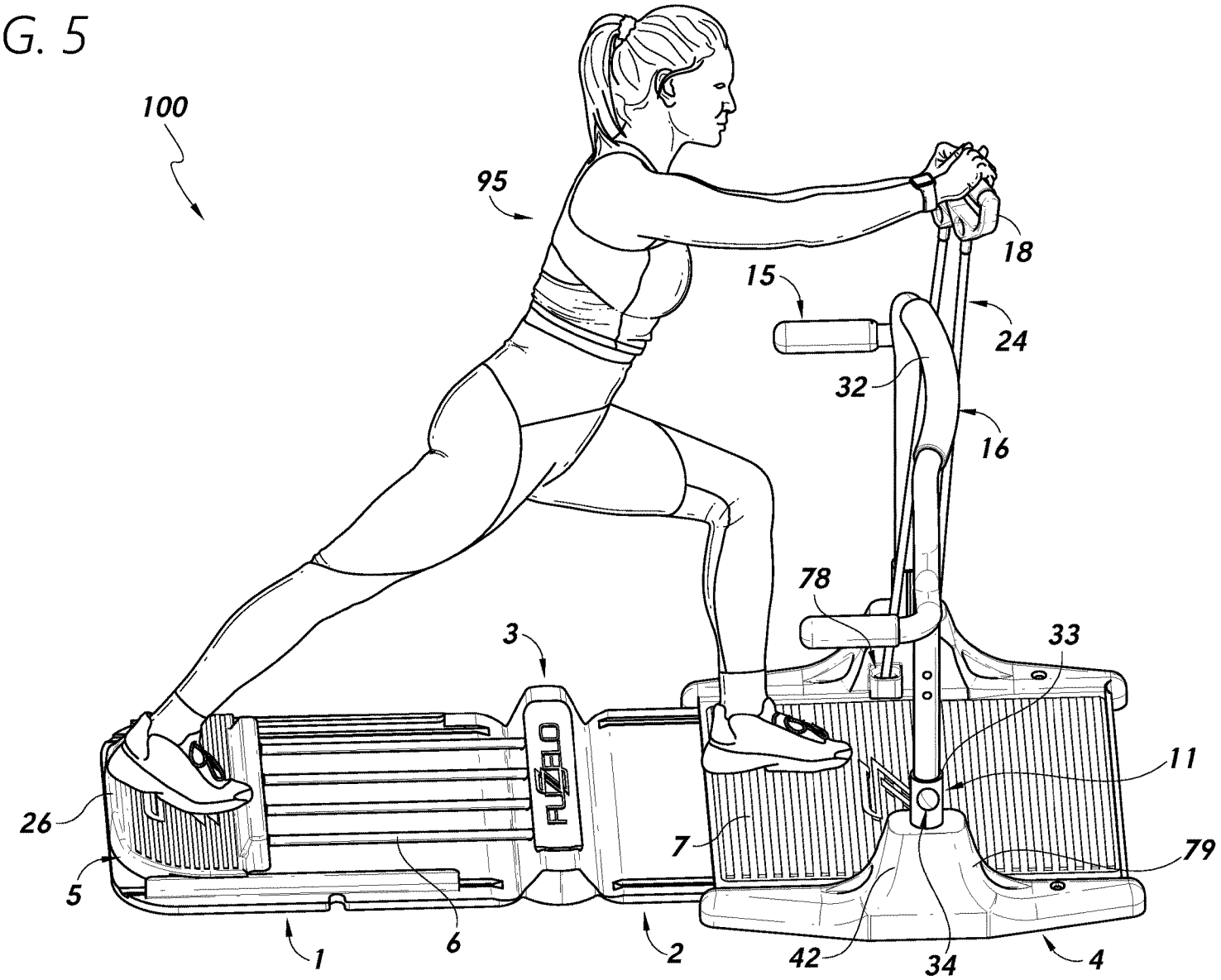
FIG. 5 shows a user utilizing an exercise system in accordance with the present disclosure with a balance bar component of the system in a raised position/configuration in accordance with one or more embodiments.
Figure 6:
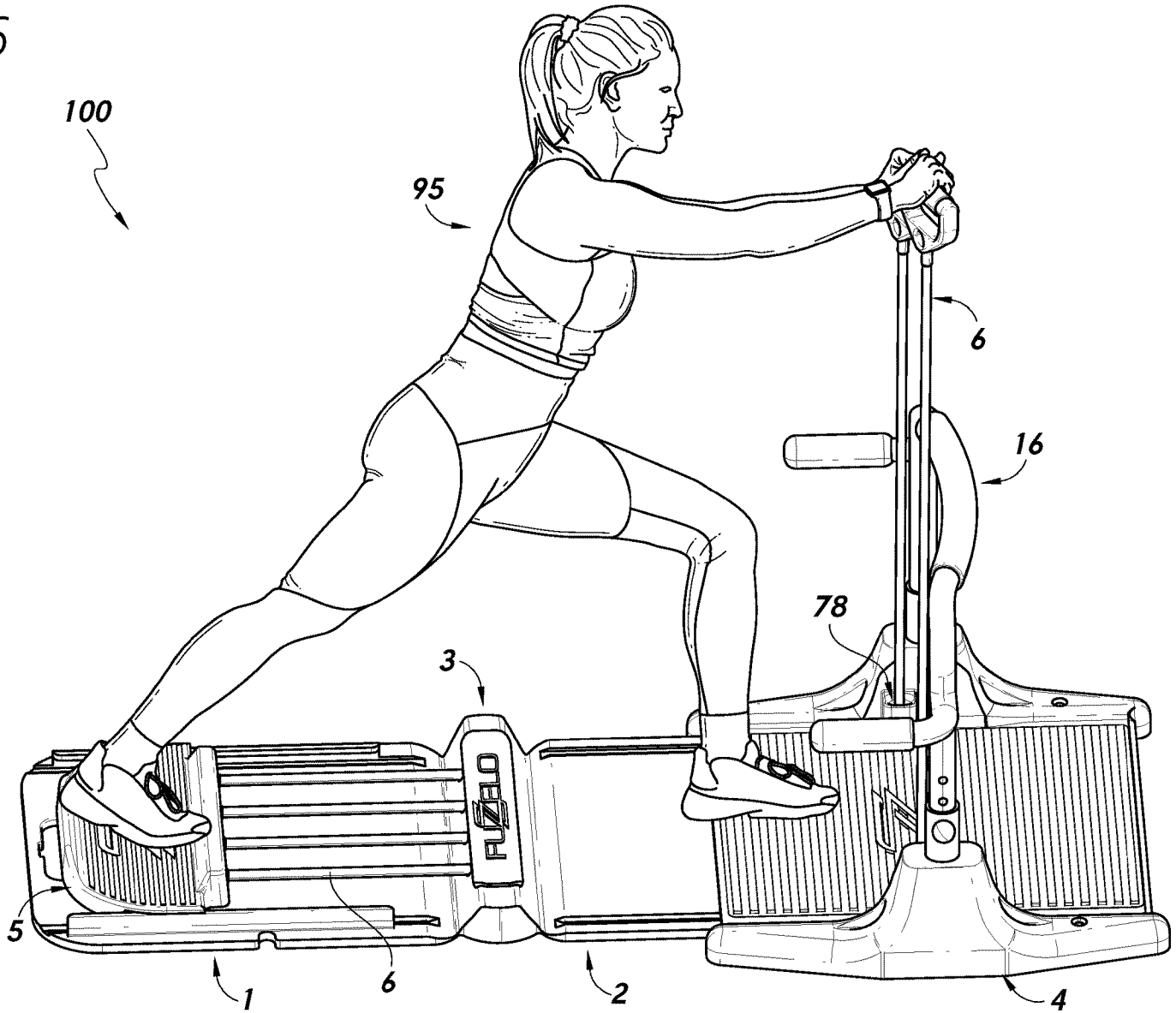
FIG. 6 shows a user utilizing an exercise system in accordance with the present disclosure with a resistance training chassis module positioned in a partially retracted position relative to an exercise bar stand in accordance with one or more embodiments.

FIG. 4 shows a user 95 utilizing an exercise system 100 in accordance with the present disclosure with an exercise/balance bar component 16 of the system 100 in a lowered position/configuration. FIG. 5 shows the user 95 utilizing the exercise system 100 with the exercise/balance bar 16 in a raised position/configuration. FIG. 6 shows the user 95 utilizing the exercise system 100 with a glide unit 30 thereof positioned/configured in a wide-stance configuration, wherein the glide unit 30 and board 2 are retracted by a desirable distance relative to the position of the board 2 relative to the bar stand/base 4 in the configurations of FIGS. 4 and 5.

The system 100 can operate as a reformer system wherein the user 95 can place an extremity (e.g., foot) on a carriage/sled component 5, and another extremity (e.g., foot) on a fixed platform (e.g., platform 7, platform 2). Springs/bands 6 or other resistance members can resiliently bias the carriage 5 toward the direction of the fixed platform and/or bar 16. The user 95, as shows, can stand (or sit or lie) on the carriage 5 and push against a surface, such as a foot bar portion/flange to move the carriage 5 away from foot bar. The user 95 can additionally grasp the ends 18 of a pair of resistance bands 24 to perform upper-body exercise.

Conventional reformer devices do not provide adjustable handle grips near the elevated portion of the apparatus that a user can grasp during various exercise movements and routines using. Embodiments of the present disclosure advantageously provide reformer/exercise systems that are relatively simple and easy to use, and include a compact convertible platform mechanism that can convert from a slide board to various other exercise with relatively minor modifications. For example, the user 95 can perform exercises in different planes standing on the elevated platform 7, or perform exercises from a seated position, kneeling, lying, or otherwise from the elevate platform 7. Embodiments of the present disclosure further provide one or more handle members that are adjustable to suit a wide range of users exercising in a seated position on the platform 7 (can also be referred to as a 'chair' in some contexts).

As with other embodiments disclosed herein, the system 100 in FIGS. 4-6 includes a glide module 30, which includes a chassis/frame formed of first 1 and second 2 boards/panels connected together by a resistance compartment/dock 3, wherein resistance bands 6 can be connected from the resistance compartment/dock 3 to the Pilates foot plate 5. Various numbers/types of resistance bands 6 can be used to provide the desired resistance force. In some embodiments, the convertible platform 30, in the open configuration shown, can have planar surfaces having an approximately horizontal orientations when laid on the ground or other surface for exercise use. The Pilate glide module 30 panels/boards 1,2 can be folded-up together via hinges on both sides connecting to the resistance band dock/compartment section 3 (see FIG. 11), which can produce a storing and/or transport configuration of the glide module 30 that is suitable for sliding under a bed or hanging on back of door or closet.

The fixed foot platform 7 can connect to and sit at least partially over/on one of the glide module boards/panels 1, 2 and provide various additional exercise options. The platform 7 can be associated with an exercise bar stand/base 4, including a leg bases 42 for additional stability. The carriage 5 and/or fixed platform 7 can have non-slip foot cushion surfaces. As described in detail above, the bar stand 4 can have integrated balance bar 16 storage features 10.

The system 100 can be used by the user 95 in connection with yoga, Pilates, and/or stretching exercises, among other exercises. Positioning the bar 16 in the lowered configuration shown in FIG. 4 can provide a relatively stable position for the bar 16, potentially providing greater balance and stability during exercise, such as may be helpful during stretching and warm-up. The vertical height of the balance bar is adjustable from a first position (FIG. 4) to at least a second position (FIG. 5) relative to a ground surface. In the configurations illustrated in FIGS. 4-6, the planar surface of the platform 7 is positioned above the planar support surface of the carriage 5, thereby permitting the user 95 to perform a variety of exercises on the platform 7 in a different plane of movement from a standing, kneeling, or lying position.

The system 100 can include a second set of resistance bands 24 that can provide for simultaneous muscle group exercises when used in combination with the sliding carriage 5. For example, the user 95 can perform a resistance lunge while doing a squat with downward resistance for squat motion and forward resistance for leg movement, while doing a single leg squat with a second leg pushing the carriage 5 backward under resistance. In some examples, the exercise system 100 can provide for multiple (e.g., up to 39 or more) exercises, which can include yoga resistance stretches, Pilates reverse and/or side lunges, back splits, side arm work, knee stretches, squats, curls, triceps, resistance push up, upper lower back hamstrings, deltoid exercises, chest exercises, and many others. The carriage 5 can also be used for cardio gliding exercises.

The foot plate/carriage 5 is elastically attached to the resistance device dock/hub/console of the glide module 30 via one or more resistance bands 6, and the handles 18 are elastically attached to the base/stand 4 via the bands 24. The base/stand 4 can include certain ports 78 through which the resistance bands 24 may pass for attachment within and/or beneath the leg bases 42.

The position of the crossbar 32 and the side handles 15 can be adjusted such that they can be moved a first position height relative to the ground surface to a second height relative to the ground surface, the second height being further away from the ground surface than the first height. Also, the second portion of each handle member can be selectively rotatable about an axis extending approximately through the centerline of the first portion of the handle member such that the rotational orientation of each handle member can be adjusted from a first rotational orientation to at least a second rotational orientation about the axis extending approximately through the centerline of the first portion of the handle member.

Figure 7A:
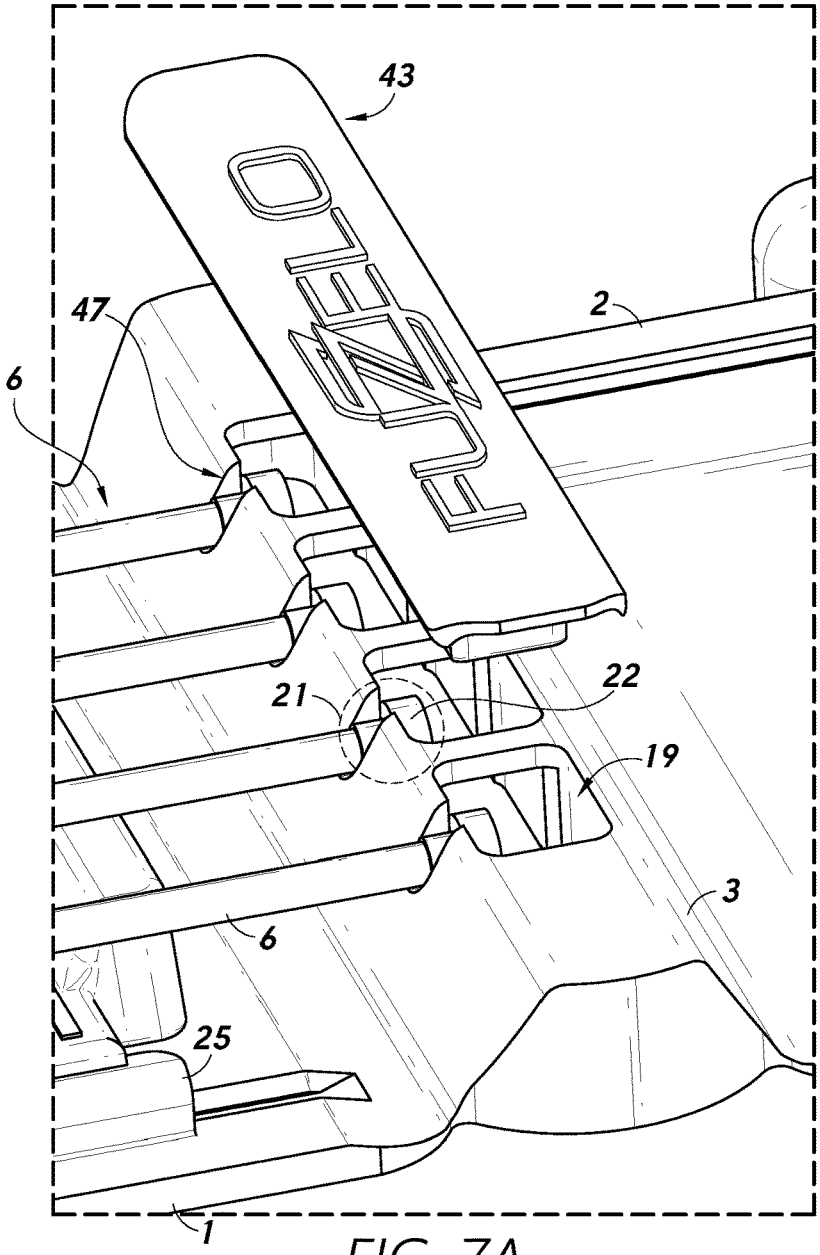
FIG. 7A shows a close-up view of a resistance band dock/hub in accordance with one or more embodiments.
Figure 7B:
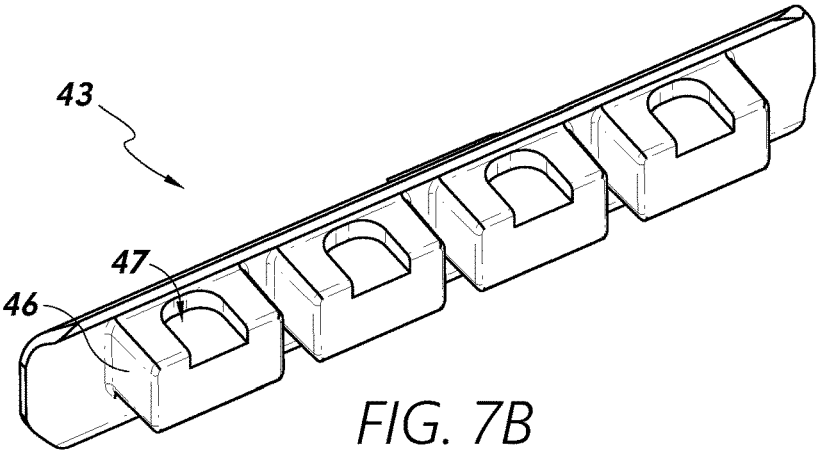
FIG. 7B shows an underside view of an anchor well cover in accordance with one or more embodiments.

FIG. 7A shows a close-up view of the resistance band dock/hub 3 of any of the systems 100 disclosed above. In some implementations, the system 100 may include a cover plate/feature 43, which may be configured to cover the anchor wells/openings 19 that are configured to receive proximal ends/portions of the resistance bands 6. FIG. 7B shows an underside view of the cover 43 in accordance with one or more embodiments. Such covering 43 may prevent the resistance band(s) 6 from becoming dislodged from the dock/hub 3, thereby providing a safety benefit, as tension resistance bands can recoil when released in an uncontrolled manner from the engagement with the dock/hub 3 in a manner that can cause physical harm to a user or damage to property. The resistance band 6 may have a common resistance/tension characteristic, or the bands may have varying resistances/tensions in different bands. The dock/hub 3 may allow for interchangeability of resistance bands 6 to provide more or less resistance as desired by the user. FIG. 7B shows projection forms 46 emanating from the underside of the cover 43 that may be shaped and are configured to nest within the wells/openings 19 to secure the cover plate 43 to the dock 3. For example, the projection forms 46 may have a peg-and-hole design, or box-and-socket, wherein the projections 46 provide interlocking connection that may have a pressure-fit engagement with the wells/receptacles 19 when inserted therein. In some implementations, the projections 46 may include certain notches 47 or other features configured to accommodate and/or secure the anchor ends 22 of the resistance bands 6 when the projections 46 are fit in the wells 19. In some implementations, the resistance bands 6 can be adjusted within the housing of the dock 3 by tightening the band using circular tension or similar mechanism.

Figure 8:
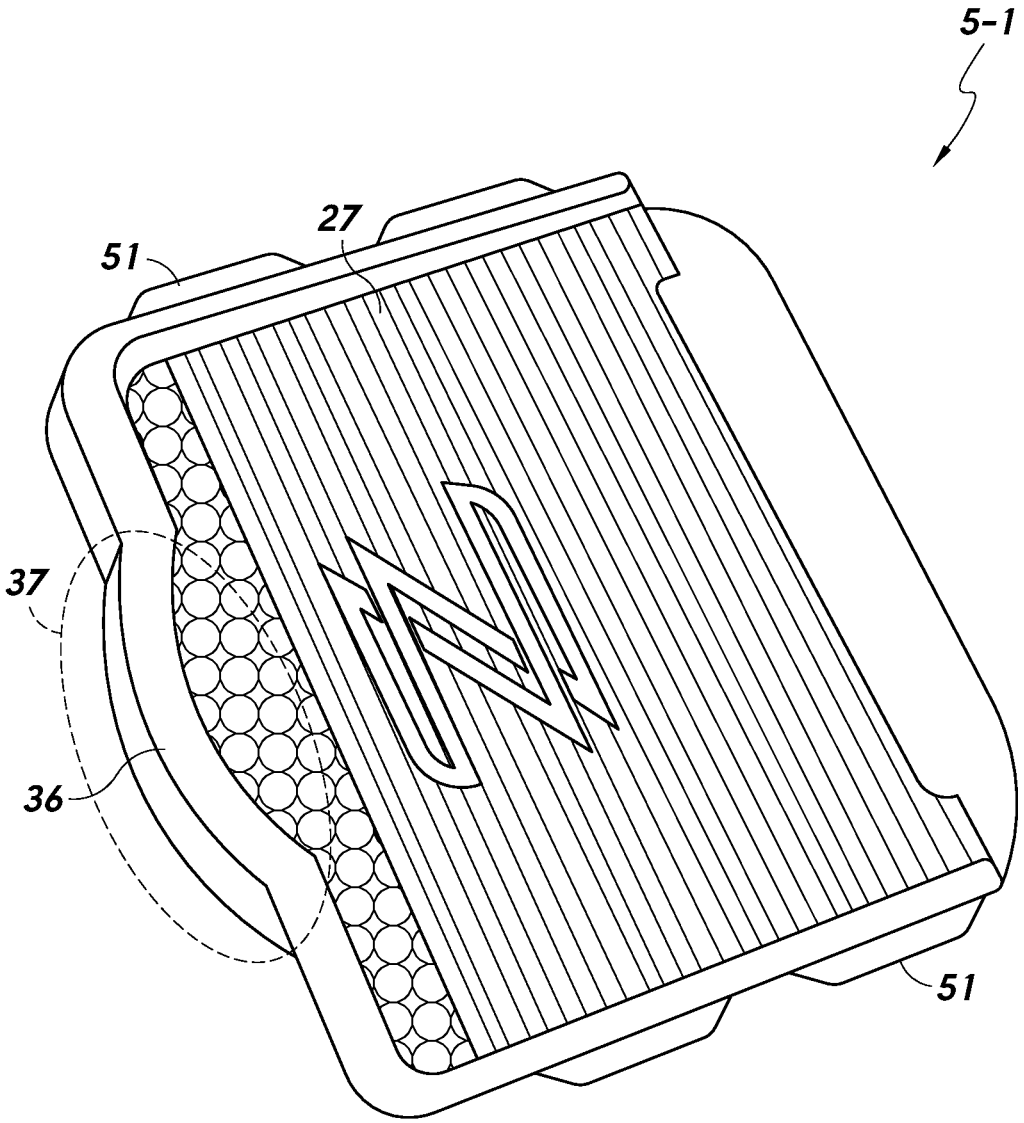
FIG. 8 shows an isolated perspective view of a sliding carriage/plate of an exercise system in accordance with one or more embodiments.

FIG. 8 shows an isolated view of the sliding carriage/plate 5 of any of FIGS. 1-1-6 in accordance with one or more embodiments. The image of FIG. 8 shows laterally projecting tabs/tongues 51, which may configured to fit into a groove/channel of the track system 25 of a glide module. The mating projections 51 may have a blade-type configuration, such that they slide as a sliding tab or tongue feature in the channel/groove of the track 25. FIG. 8 shows an example in which a male component of a tongue-and-groove sliding coupling between a sled/carriage and one or more linear rails/tracks is associated with the sled/carriage, whereas the corresponding female channel/groove is associated with the linear track/rail. Although two tongue features 51 are shown on each side of the sliding carriage/plate 5, it should be understood that any number or configuration of tongue features may be implemented.

Figure 9A:
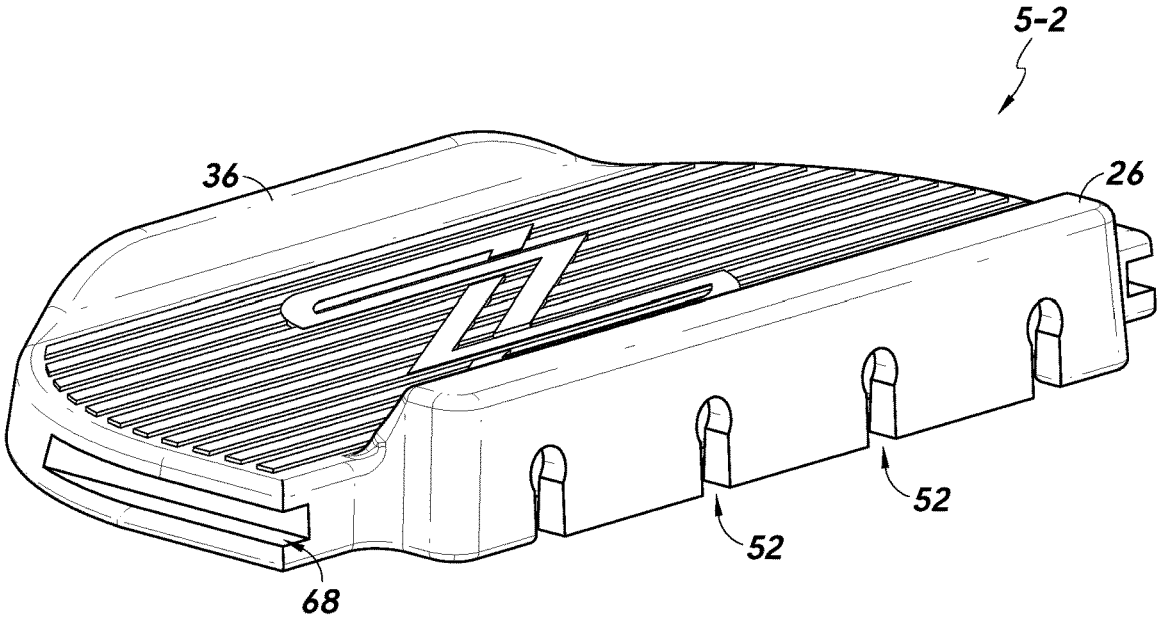
Figure 9B:
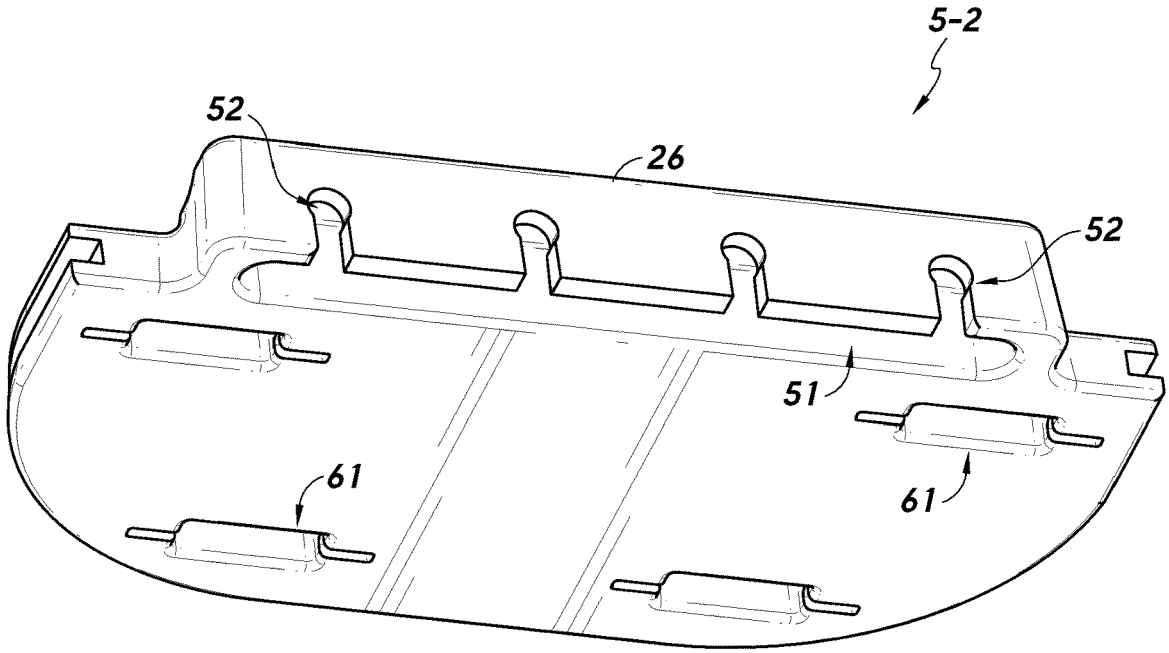

FIGS. 9A and 9B show an example implementation of any of the sliding carriages/plates disclosed herein. As with embodiments described above, the sliding carriage/plate 5-2 may be configured to couple to distal ends of resistance bands, such that sliding movement of the carriage/plate 5-2 pulls on the resistance bands, such that the resistance bands oppose the motion/movement of the carriage 5-2. In some implementations, sliding carriages/plates of the present disclosure include proximal coupling features 52 for coupling/securing resistance bands thereto. For example, as shown in FIGS. 9A and 9B, the carriage 5-2 can include slot retention features 52, wherein distal ends of the resistance bands fit within respective ones of the slots 52 in a T-slot configuration/mechanism. Therefore, resistance bands may be coupled to the carriage 5-2 by placing a distal anchor/flange of the resistance bands in a cavity/channel 51 and sliding the bands into the vertical slots 52, wherein the anchors retain the resistance bands within the channel 51 when the bands are disposed in the slots 52. The resistance band retention features 52 may be integrated with a proximal stopper 26 of the carriage 5-2 or any other feature of the carriage 5-2.

The embodiment of FIGS. 9A and 9B shows side grooves 68, which may be configured to slide along tongue feature(s) of a foot plate track system 25 of a glide module. The mating grooves/channels 68 may have a trench-type configuration, such that they slide around a sliding tab or tongue feature of the track 25. FIGS. 9A and 9B show an example in which a female channel component of a tongue-and-groove sliding coupling between a sled/carriage and one or more linear guiderails/tracks is associated with the sled/carriage, whereas the corresponding male tongue feature is associated with the linear track/rail. As with any carriage/sled/plate disclosed herein, the carriage/plate 5-2 may include roller receptacles 61 configured to receive one or more pins and/or rollers configured to facilitate movement of the carriage/plate 5-2.

Figure 10A:
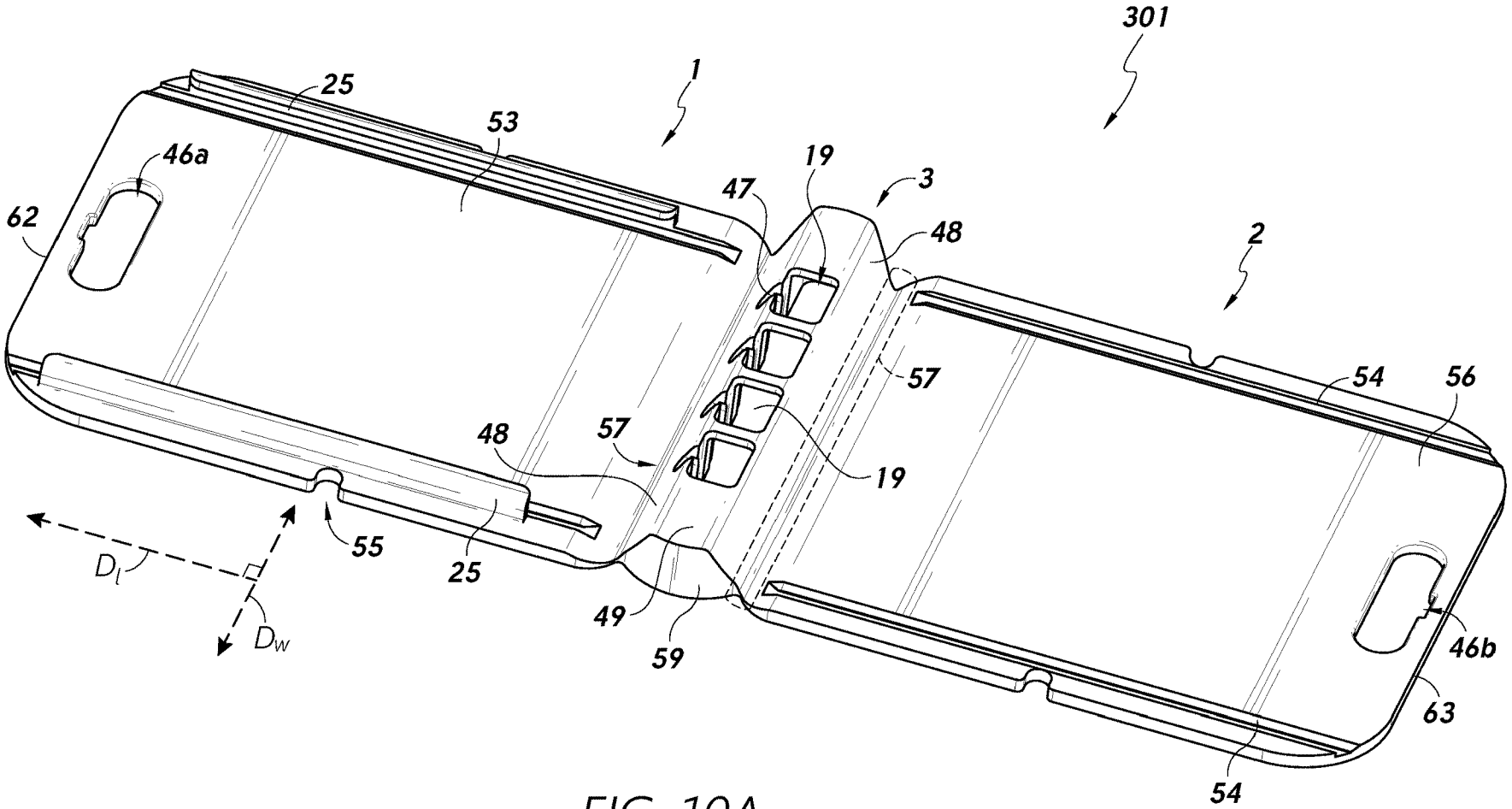
FIGS. 10A-10C show perspective, top, and bottom views, respectively, of a dual-panel/board carriage chassis in accordance with one or more embodiments.
Figure 10B:
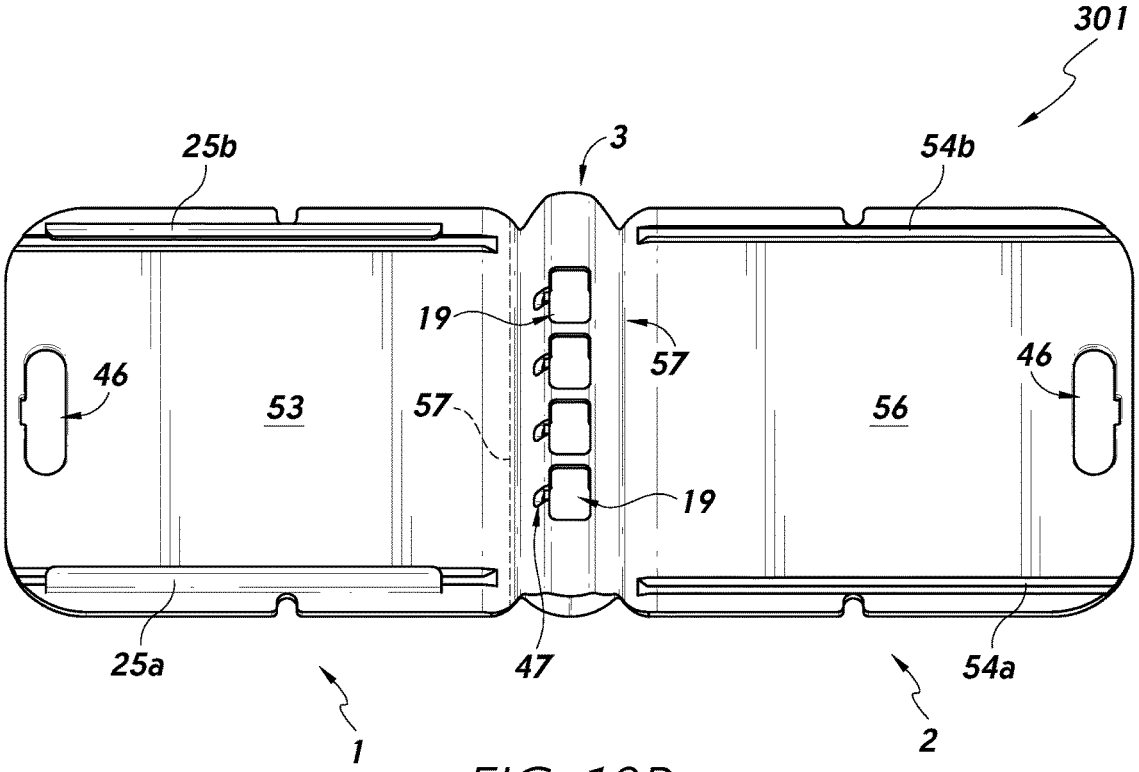
Figure 10C:
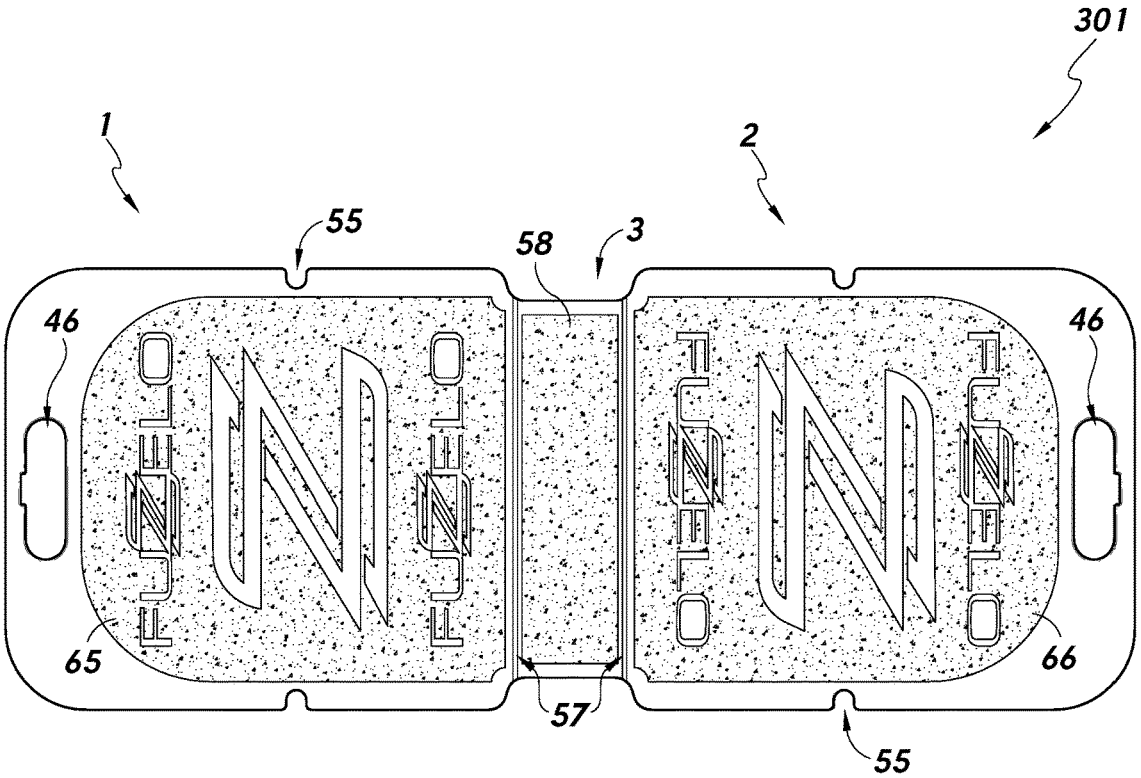

FIGS. 10A-10C show perspective, top, and bottom views, respectively, of a chassis 301 of a dual-panel/board glide module 30 in accordance with one or more embodiments of the present disclosure. FIGS. 10A-10C show the carriage chassis/platform 301 in an open/extended configuration, which may correspond to configuration for use by a user. For example, in the open/extended configuration shown, the chassis/platform 301 may be in a configuration to engage with a balance bar stand/base 4 or other piece of equipment to collectively provide a resistance-based exercise system as disclosed herein.

The chassis 301 includes a first tray/board/panel 1 and a second tray/board/panel 2. The first 1 and second 2 boards may be coupled to a central hub 3, which is described in detail above. For example, the hub 3 may connect to the platforms 1, 2 at interfaces 57, which may have hinge mechanism(s) associated therewith. For example, the chassis 301 may be configured to fold along the hinge lines 57 to allow the chassis 301 to transition between an open/expanded configuration as shown in FIGS. 10A-10C, and a folded/stowed configuration that may be suitable for storage and/or transport of the chassis 301.

In some implementations, the hub 3, which may serve as a resistance band dock, has a side profile (see FIG. 10E) that has a truncated triangular shape with sloped sides 48 and a flat or rounded top surface 49. However, it should be understood that the hub 3 may have any suitable shape or dimensions. The top surface 49 of the hub/dock 3 may stand vertically above the flat surfaces 53, 56 of the respective trays/boards 1, 2 on opposite longitudinal (Di) sides of the hub 3. The resistance band dock/hub 3 can have the form of a trapezoidal ridge, which may be elongate with a length thereof oriented in the transverse dimension $D_w$ relative to the lengthwise dimension $D_l$. The dock/hub 3 can be a raised docking structure, as shown, or may be flat. For example, for flat configurations, the docking features may comprise rings or hooks projecting from the flat surface of the dock/hub. The dock/hub 3 is coupled to the respective boards 1, 2 on long sides 57 thereof, which coupling areas may operate as linear hinges, as described above. The structure 3 can function as a hinge/pivot bar/block, which may have the form of a ridge.

One or both of the trays/boards 1, 2 may have associated therewith a handle feature 46. For example, as illustrated, each of the trays/boards 1, 2 can include apertures 46 through which the user's fingers can be placed to allow for manual engagement therewith for holding and/or transporting of the chassis 301. For example, the handle features 46 may serve as recessed handles that are flush with one or more surfaces of the boards/panels 1, 2. The handle apertures 46*a*, 46*b* may have any suitable or desirable shape, such as the illustrated elongated oval/stadium shapes. The handles 46 may advantageously be positioned relatively close to distal ends 62, 63 of the respective trays/boards 1, 2, such as within six inches of the ends 62, 63, or within the end 20% of the length of the trays/boards.

As with other embodiments disclosed herein, the first tray/panel/board 1 may have associated therewith tracks 25 running on opposite sides of the tray 1, wherein such tracks 25 can facilitate linear translation of a sliding carriage platform/plate (e.g., foot plate) as described herein. The second tray/panel 2 may or may not likewise have carriage tracks associated therewith. In some implementations, the second tray/panel/board 2 includes lengthwise-running channels 54 (or projections/tongues), which may facilitate alignment and/or engagement with a balance bar stand/base structure and/or associated standing platform, as described herein. For example, the channels 54 may be configured to have corresponding projections associated with a separate structure running therethrough to guide insertion of the panel/board 2 into a space defined by the other structure/base of the relevant system. The track(s) 25 can be any type of linear or non-linear guiderails, rails, slide tracks, guide channels, or the like configured to allow a foot platform to operate as a rail-mounted carriage.

Figure 11:
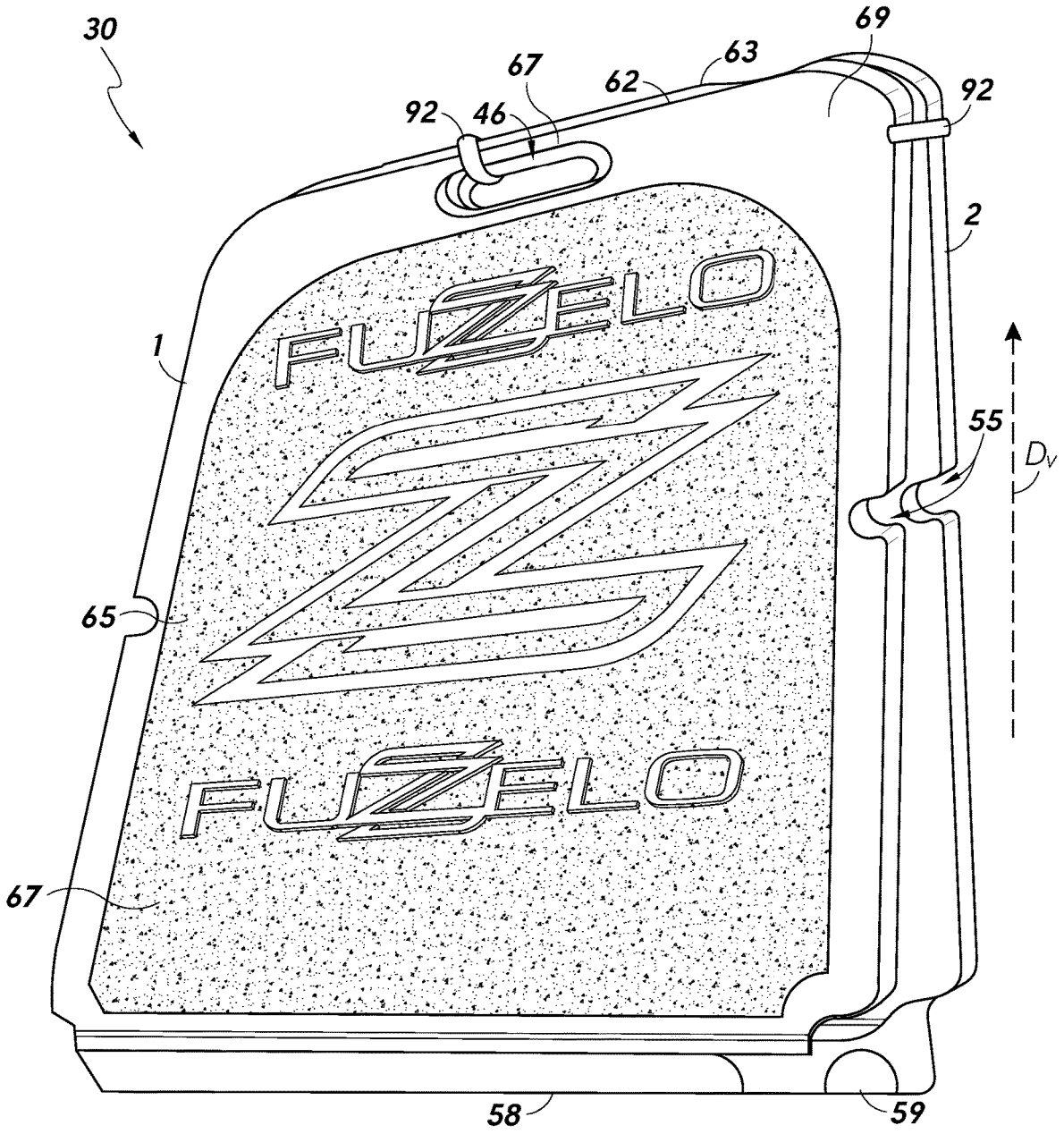
FIG. 11 shows a foot carriage/platform chassis in a folded storage configuration in accordance with one or more embodiments.

The surfaces 53, 56 of the panels/boards 1, 2 can be smooth, or can have traction grooves or other non-slip features associated therewith to accommodate standing or hand placement thereon by the user in connection with various exercises. The bottom view of FIG. 10C shows the bottom surfaces 65, 66 of the respective trays one, two, which may be positioned against the floor or other surface when the chassis 301 is in the open/expanded configuration shown in FIGS. 10A and 10B when the device 301 is in use. The surfaces 65, 66 can include traction features, such as pads, grooves, tacky surface material, or the like, to promote stationary positioning of the chassis 301 when placed on the floor during exercise. In the folded/stowed configuration shown in FIG. 11, the surfaces 65, 66 may be outer/external surfaces that may be visible when the folded chassis 301 is in an upright position as shown in FIG. 11, wherein the chassis 301 may sit/be-supported on the bottom surface 58 of the hub/dock portion 3.

The central hub/dock 3 can interconnect the first board 1 and the second board 2. The sides of the dock/hub 3 may form hinged connections with the first board 1 and/or the second board 2 to allow the first board 1 and/or second board 2 to fold and/or extend towards each other to reduce the profile of the chassis 301 and/or combined glide module (e.g., including a sliding carriage and/or resistance band(s)).

The anchor wells 19 may have opening on the top side 49 of the dock 3, as well as band slots 47 on the side surface 48, which may be ramped. The slots 47 are contiguous with the wells 19 to allow the bands 6 to pass from the wells 19 into the slots 47. The panels/boards 1, 2 of the resistance-training platform/chassis 30 can have the form of wings, leaves, flaps, or the like. The sides 48 of the hub can be opposite-facing ramps, as shown in FIG. 10A.

Figure 10D:
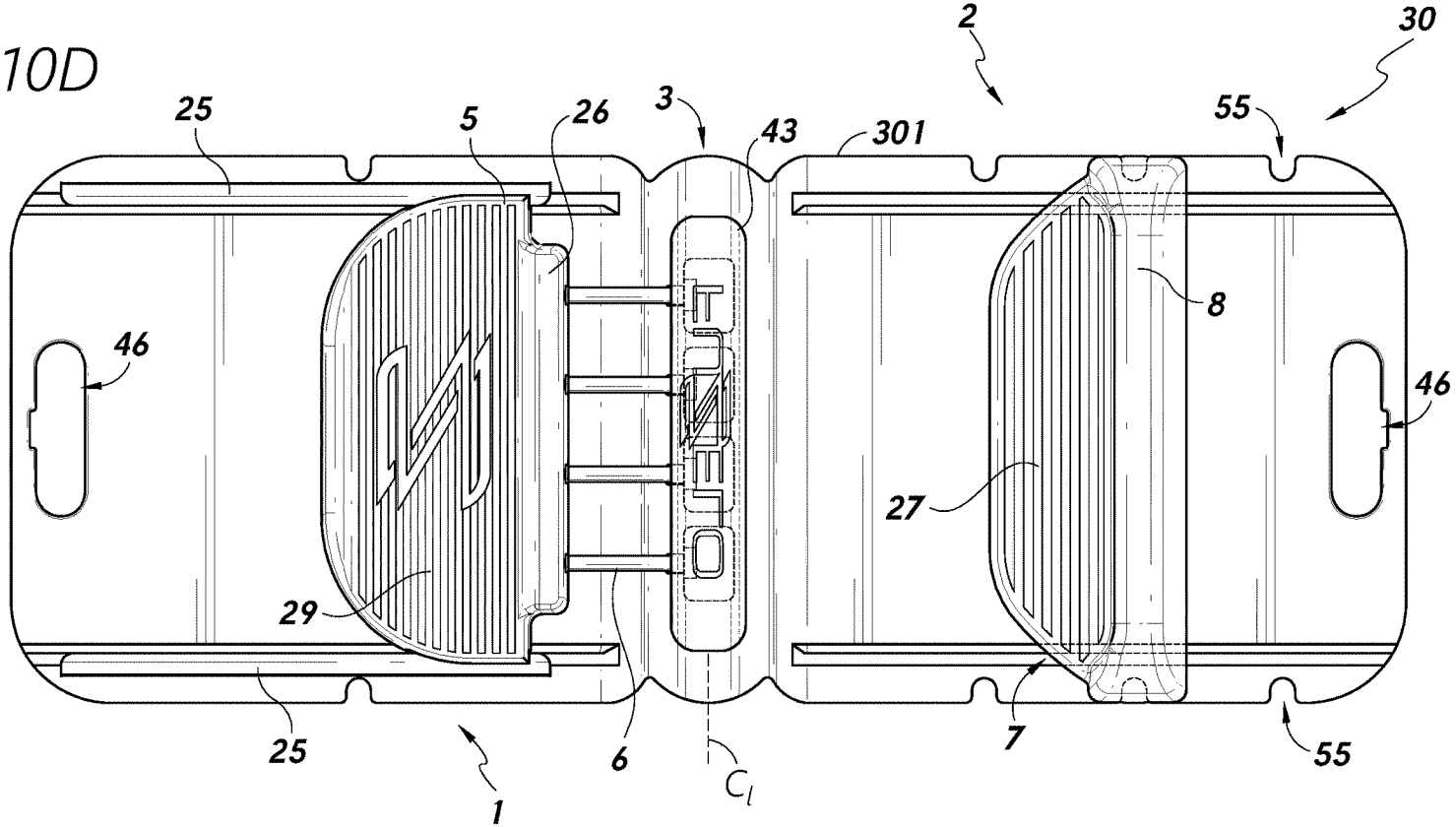
FIGS. 10D and 10E show top and side views, respectively, of a foot plate carriage assembly in accordance with one or more embodiments.
Figure 10E:
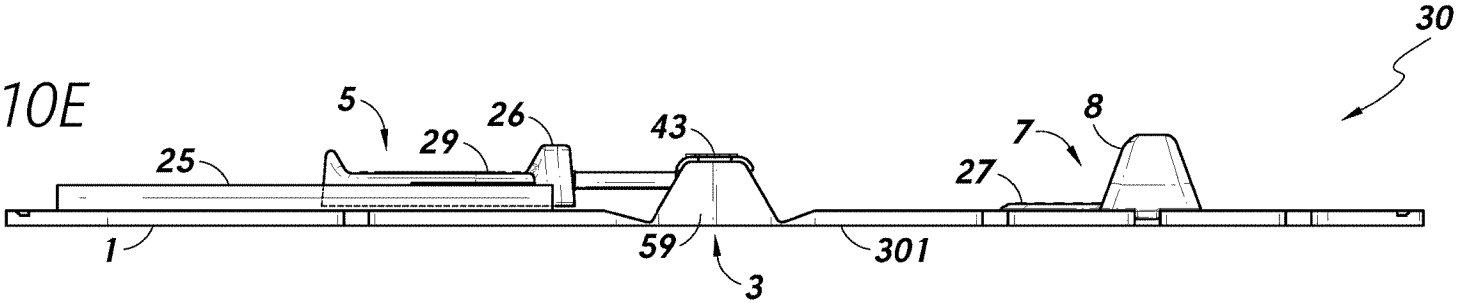

FIGS. 10D and 10E show top and side views, respectively, of the hinged dual-board carriage platform/chassis 301 described above with additional sliding and/or fixed foot plates, and/or resistance band components, which together with the chassis 301 may be considered a glide module 30 for use with exercise systems disclosed herein. In FIGS. 10D and 10E, a sliding carriage/sled 5, which may serve as a foot or hand plate/platform as described in detail herein, is coupled to the dock 3 by resistance devices 6, such as resistance bands or the like. For example, the resistance bands 6, as described in detail herein, may be coupled to the dock/hub 3 at proximal/end portions thereof, such as by placing anchor portions associated with the proximal ends of the bands 6 into slots/cavities of the dock/hub 3 to thereby secure the resistance bands 6 to the dock/hub 3. As described above, a cover 43 or other component may be disposed over the wells/openings into which the resistance band ends/anchors are placed to provide an improved aesthetic for the chassis 301 and/or protect/prevent the lodgment of the resistance band anchors. The distal ends/portions of resistance bands 6 may be coupled to and/or integrated with the sled/carriage 5 in some manner as disclosed herein, or known to those having skill in the art in view of the present disclosure.

The carriage/sled 5 may further be mated with the tracks 25 in a manner as to allow for free sliding within the tracks 25 by the carriage/sled 5, subject to friction between the carriage/sled 5 in the tracks 25 and/or resistance forces acting on the proximal portion 26 of the sled/carriage 5 by the resistance bands 6. The second board 2 can include guide rail(s), which may be male or female components of a tongue-and-groove coupling system, as described in detail herein. The guide feature(s) 54 may align the board with another piece of equipment in a modular assembly as described herein. Either or both of the boards 1, 2 can include side notch(es) 55, which may mate with corresponding key(s) of an exercise bar stand/base structure to provide discrete coupling/mating positions when the glide module 30 is inserted in a space defined by the stand/base structure.

The second board/panel 2 can have coupled thereto, or otherwise positioned in proximity thereto, or associated therewith, a stationary platform/plate 7, which may include one or more of a platform surface 27 and/or lateral stopper 8, as described in detail herein. For example, the stationary plate 7 may be coupled to the board/panel 2, or alternatively may be coupled to a balance bar stand/base or other structure under/into which the board/panel 2 may be inserted as part of an exercise assembly/system. Although FIGS. 10D and 10E show a stationary plate 7 associated with the second board/panel 2, it should be understood that in some implementations, the chassis/module 30 is configured such that a sliding sled/carriage can be associated with the second board/panel 2 as well. For example, the chassis 301 may be configured substantially as a mirror across a lengthwise center $C_l$ of the chassis 301, such that opposing carriages/sleds can move in the lengthwise dimension $D_l$ away from the dock/hub 3 in both/opposite directions.

The foot/hand plate surfaces 27, 29 may be configured to have any type of extremity (e.g., hand, foot) placed thereon, wherein the stationary surface 27 may allow for stationary placement of a user extremity, whereas the sliding surface can allow for relative movement of a second extremity of the user relative to the first extremity placed on the stationary surface 27. Such combined stationary and sliding platform/surface assembly can facilitate implementation of a variety of exercises, such as those associated with Pilates, yoga, and/or other strength for balance training. Multiple resistance bands can be attached to the glide platform 5 and the resistance band dock/compartment, allowing for an individual to place their foot in multiple positions to allow forward, back, and side Pilates exercises. With the different connection features of the glide module, the module 30 can operate as a convertible platform that is reconfigurable into various arrangements.

FIG. 11, which is described in some detail above, shows a foot plate/platform chassis/module 30 in a folded storage configuration in accordance with one or more embodiments of the present disclosure. As used herein, the term 'chassis,' and like terms, may be used to refer to the dual-board frame/chassis itself without attached sliding platform(s) or resistance bands, or may refer to the combined assembly/module (e.g., glide module). The module 30 is configured to fold in half in a manner as to provide for portability. For example, the module 30 can include handles on each end, which come together in the folded configuration. Within the handles 46, there can be slots to allow the unit to be hung on the door of a closet or other fixture or stored under a bed or couch. The outer/under side 65 of the chassis 30 can advantageously have a non-slip surface. The chassis/module 30 can be unfolded from the stowed configuration shown in FIG. 11 to an open configuration as shown and described through the present disclosure.

In the folded configuration, the panels 1, 2 may be brought together at respective distal portions/ends 62, 63 thereof to reduce a lengthwise profile of the chassis 30. When the boards/panels 1, 2 are folded as shown in FIG. 11 to bring the distal ends 62, 63 thereof together, the handle apertures 46 may at least partially overlap to provide a combined handle aperture, wherein the user may insert one or more digits (e.g., fingers) through the combined apertures 46 to thereby allow the user to manually hold/grab distal grip handle/strip portions 67 to hold the chassis 30. Although described as handle holds/apertures 46/67 in some contexts, it should be understood that the apertures/handles 46/67 may be used to hang the chassis 30 from a wall hook, or similar mounting/hanging structure/device. For example, a user may hang the chassis 30 from a wall mount/hook in the folded configuration shown in FIG. 11 by passing the hook through both handle apertures 46*a*, 46*b*, or alternatively may hang the chassis 30 in the unfolded/open configuration shown in FIGS. 10A-10C by inserting a mounting bracket (e.g., peg, clip, arm, hook) through only one of the handle apertures 46*a*, 46*b*.

The chassis 30 may be folded into the stowed/folded configuration shown in FIG. 11 with or without the sliding carriage/sled 5 coupled thereto. For example, in some implementations, the folded configuration shown in FIG. 11 may provide a triangular side profile defining a triangular space between the panels 1, 2, wherein such space may be greater towards the base/hub/bottom thereof and may taper/narrow moving in the vertical dimension $D_v$, wherein the carriage/sled 5 may fit within such volume in the folded/stowed configuration.

The platform unit/module 30 may be configured to be portable in that the handle(s) 46 facilitate carrying of the unit/module 30. The back/underside 65, 59 of the boards 1, 2 and/or dock 3 may have a varying texture and/or surface, and/or may comprise relatively smooth portions 69 and/or relatively rough portions 67 configured to improve grip of the platform unit/module 30. The rough portions 67 may comprise a rough, embossed, and/or textured surface. In some examples, logos and/or lettering may be embossed or debossed within the rough portions 67.

With the longitudinal ends of the boards 1, 2 brought together, the boards may be secured in the stowed position relative to one another by one or more clips, straps, or other locking features 92, which may be implemented on the sides or in the area of the handle(s) 46. The areas of the boards 1, 2 close to the hinge(s) 57 can be considered the base of the boards. The boards are configured to flex/pivot about the hinge(s) 57.

Figure 12:
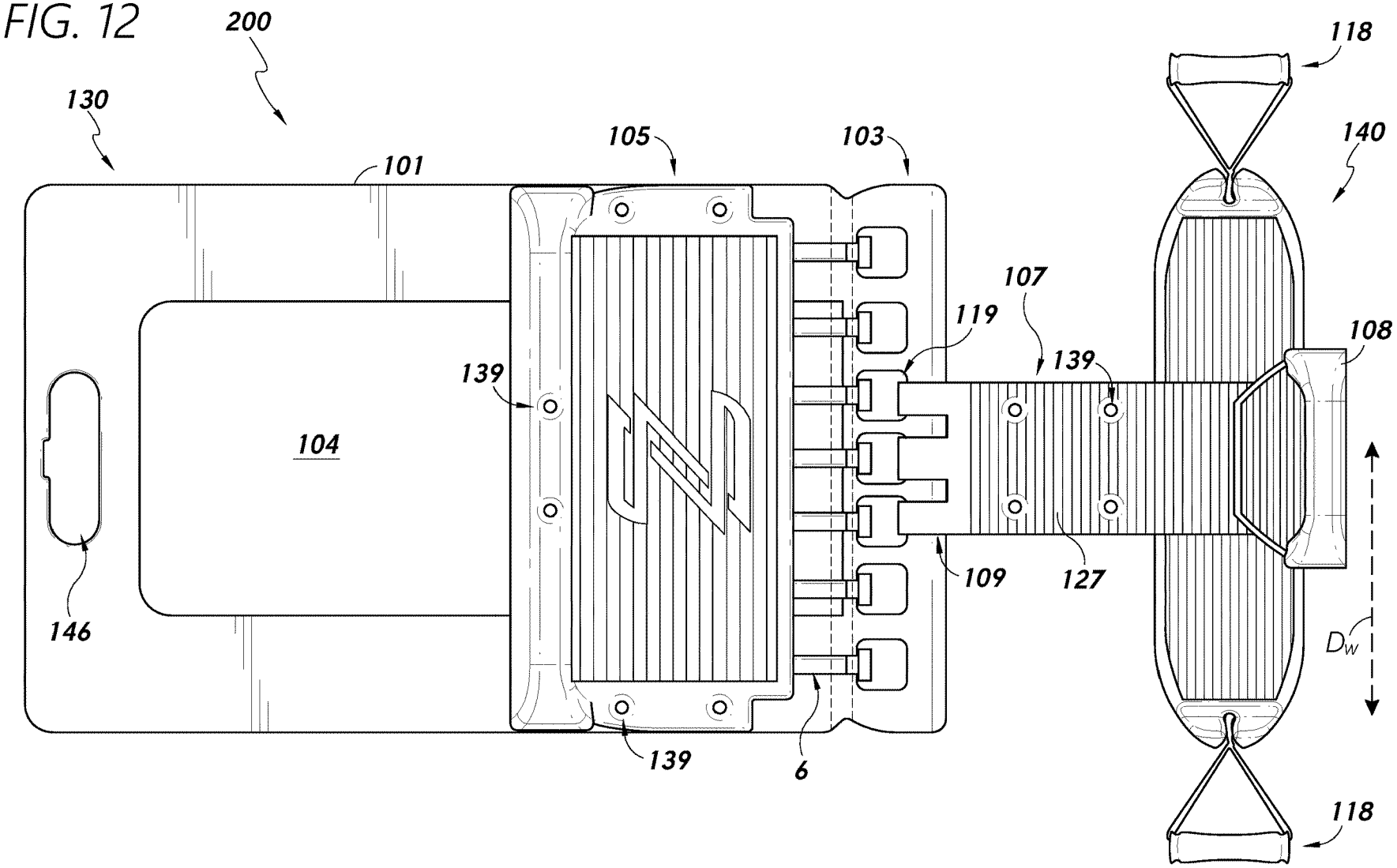
FIG. 12 illustrates an example of a reformer gym system in accordance with one or more embodiments.

FIG. 12 illustrates an example of a sliding resistance gym system in accordance with one or more embodiments. The system 200 is a component similar to various examples disclosed throughout the present disclosure. For example, any of the components of the system 200 may be understood to be similar to any other component described herein in connection with one or more embodiments, wherein such component(s) share similarities with the illustrated and described components of the system 200.

The system 200 may include a chassis 130 configured to have coupled and/or otherwise associated therewith a sliding sled/carriage 105, which may be similar in one or more respects to any of the movable sleds/carriages disclosed herein, such as foot plates or the like. The carriage 105 may be coupled via resistance elements/devices 6 (e.g., resistance bands) to a dock/hub portion 103 of the chassis 130, as with other examples disclosed herein. The chassis 130 may include a panel/tray 101 coupled to one lengthwise Di side of the dock/hub 103. However, unlike certain other examples disclosed herein, the chassis 130 may not have a second board/panel disposed on an opposite side of the dock/hub 103 from the first board 101.

In some implementations, the system 200 may be configured to have a spacer/bracket/plate structure 107 coupled to the dock/hub 103, such as through engagement of one or more engagement features (e.g., fingers, claws, hooks, or the like) 109 with openings/wells and/or other coupling features 119 of the dock/hub 103, which may allow for secure coupling between the plate/bracket 107 and the chassis 130. The bracket/plate 107 may be used as an extremity plate 107 for placement of a hand or foot during exercise. The bracket/plate 107 may be configured to have inserted therein and/or otherwise coupled thereto certain push-up bars or other apparatus(es) for manual engagement when performing various exercises with the system 200. Additionally or alternatively, the bracket/plate 107 may have a surface 127 designed for extremity support/placement (e.g., and/or foot placement) when performing exercises with the system 200, such as exercises that involve linear sliding of the sled/carriage 105. The plate 107 may include a proximal stopper 108, which may project away from the surface 127 and provide a counter surface against which user may push and/or apply force to facilitate exercise resistance for training. In some implementations, a secondary plate/structure 140 may be placed under and/or otherwise in association with the plate 107 to secure the secondary plate 140 for use in connection with various exercises. For example, the plate 140 may extend generally in the widthwise dimension $D_w$, and may have resistance bands/handles 118 coupled thereto to allow for resistance band training from a stationary fixture in connection with various exercises.

The system 200, as with other systems/components disclosed herein, can have handle mounts/holes 139 implemented in one or more components of the system 200, as shown. For example, handle (e.g., push-up handle) mounts/holes 139 may be formed/implemented in any portion of the sled 105 and/or bracket/plate 107, as shown, and/or in the board 101 or secondary plate 140.

The board/panel/tray 101 may represent a possible implementation of any of the boards/panels/trays disclosed herein in connection with any of the illustrated and/or described exercise systems. In the example embodiment of FIG. 12, the board includes an aperture/cut-out 104, which may produce a void/window in the board, which may advantageously reduce the bulkiness, material cost, and/or weight of the board 101. Any board disclosed herein may have one or more aperture/cut-out features having any shape or design. The board 101 can have a handle aperture 146 in a distal band/portion thereof, as shown.

Figure 13:
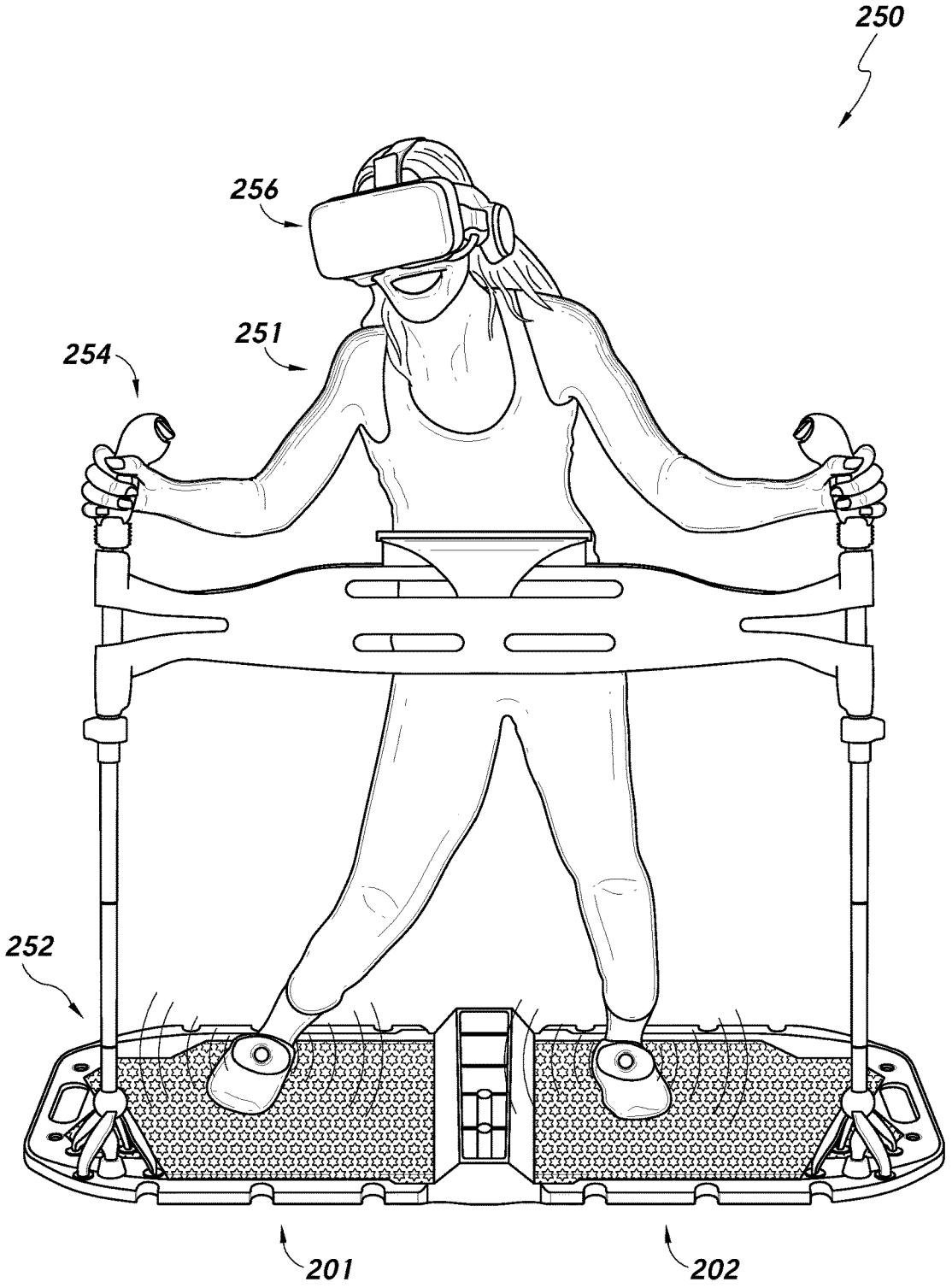
FIG. 13 illustrates an exercise platform system being used by a user in accordance with one or more embodiments.

FIG. 13 illustrates another example exercise system 250 in accordance with one or more examples. The system 250 may comprise a platform unit 252 comprising a first platform 201 and/or a second platform 202 configured for a user 251 to stand on. The system 250 may further comprise one or more handles 254 configured to be grasped by the user 251. The exercise system 250 may comprise a VR headset 256 and/or the platform unit 252 may be configured for use with a VR headset 256 configured to display a virtual environment associated with exercise actions performed by the user with the platform unit 252.

Health Metric Blockchain Data Storage

Example exercise systems can comprise computer systems configured to provide for user enrollment and/or registration. For example, user login details may be requested, received, and/or managed by one or more computer and/or computer networks. Login to the computer systems may be fully secured and/or may provide enhanced data security.

In some examples, computer systems may be configured to create a cryptographic signature of user data. While user information is managed and/or stored, the computer systems (e.g., blockchain layer) may be configured to ensure that a hash of the data is stored as a blockchain transaction and/or that data is well protected and secured. Ownership of data may be managed by user and data sharing and/or may be prohibited without acceptance from user.

Some example computer systems can comprise a blockchain solution and/or hybrid computer application that can run on blockchain and/or other system (e.g., Hyperledger Fabric). In some examples, the computer application may be built up on Ethereum and/or may provide an option to launch on web3.

User registration can comprise secure authentication of users using Blockchain and/or similar technology. In some cases, fingerprint authentication can be used. User confidential information can be secured cryptographically using Blockchain and/or similar technology. Ownership of user records may be managed in a decentralized architecture.

In some examples, the exercise systems described can incorporate direct inputs from various devices and/or applications, including Fitbit devices, Apple watches, and/or other smart devices. Health Regime suggestions may be incorporated using, for example, the Federated Decision model and/or using Blockchain. In some cases, an incentive model may be incorporated for health care experts and users of the app based on the active usage and management of health parameters.

In some examples, users may be able to store medical records into the exercise computer systems. Medical records can be received from different places (e.g., hospitals and/or labs) in one place and/or can be shared with providers as needed. Physicians may be provided with access to the information only if the user authorized.

Computer systems can comprise AI models with Blockchain transactions to automatically build a health diary for the user. AI and/or other systems may be configured to apply the user's health diary to big data, together with the security offered by blockchain technology for the management of various databases of the computer systems.

Gathered and/or stored data may be used in the development and/or enhancement of AI algorithms and/or may be secured with blockchain and/or similar systems. Such data may be used to audit intermediary steps that the AI takes to draw conclusions from the data, the integration of machine learning and AI into blockchain, and vice versa, will be used to enhance the blockchain's underlying architecture and boost the AI's potential; Additionally, blockchain may also make AI more coherent and understandable. The AI combined with blockchain may have the capability to divide and/or separate the information into blocks, providing more accurate data from users. Computer systems may be configured to trace and/or determine why decisions are made by users.

Additional Disclosure of Embodiments and Examples

Provided below is a list of examples, each of which may include aspects of any of the other examples disclosed herein. Furthermore, aspects of any example described above may be implemented in any of the numbered examples provided below.

Example 1: An exercise device comprising a first board, a second board having one or more linear rails running along a lengthwise dimension of the exercise device, an extremity platform coupled to the one or more linear rails in a sliding engagement, and a resistance band dock coupled to sides of the first board and the second board.

Example 2: The exercise device of any example disclosed herein, in particular example 1, further comprising one or more resistance bands coupling the extremity platform to the dock.

Example 3: The exercise device of any example disclosed herein, in particular example 1, wherein the dock has a raised ridge form.

Example 4: The exercise device of any example disclosed herein, in particular example 3, wherein the dock comprises one or more anchor wells configured to receive a resistance band portion of a resistance band to anchor the resistance band to the dock.

Example 5: The exercise device of any example disclosed herein, in particular example 4, wherein the resistance band portion comprises an anchor.

Example 6: The exercise device of any example disclosed herein, in particular example 4, further comprising an anchor well cover at least partially covering the one or more anchor wells.

Example 7: The exercise device of any example disclosed herein, in particular example 1, further comprising a fixed extremity platform coupled to the first board.

Example 8: The exercise device of any example disclosed herein, in particular example 1, wherein the extremity platform comprises a distal stopper flange.

Example 9: The exercise device of any example disclosed herein, in particular example 1, wherein the first board includes one or more guide rails to align the first board with another exercise device.

Example 10: The exercise device of any example disclosed herein, in particular example 9, wherein the other exercise device comprises a balance bar assembly.

Example 11: The exercise device of any example disclosed herein, in particular example 1, wherein at least one of the first board or the second board has a handle aperture.

Example 12: The exercise device of any example disclosed herein, in particular example 1, wherein the first and second boards are foldable on opposite sides of the resistance band dock.

Example 13: The exercise device of any example disclosed herein, in particular example 1, wherein at least one of the extremity platform, the resistance band dock, or the first board comprises handle-anchoring recesses.

Example 14: An exercise device comprising a first board, a second board, and a raised ridge structure coupled to a first side of the first board via a first hinge that runs along a widthwise dimension of the exercise device, and a first side of the second board via a second hinge that runs along the widthwise dimension.

Example 15: The exercise device of any example disclosed herein, in particular example 14, further comprising a first platform that is slidable over at least a portion of the first board.

Example 16: The exercise device of any example disclosed herein, in particular example 15, wherein the first board comprises one or more guide rails configured to guide linear motion of the first platform.

Example 17: The exercise device of any example disclosed herein, in particular example 15, wherein the first platform is configured to be coupled to the raised ridge structure by one or more resistance bands, such that the one or more resistance bands oppose movement of the first board in one or more directions.

Example 18: The exercise device of any example disclosed herein, in particular example 15, wherein the second board is fixed relative to a second platform.

Example 19: The exercise device of any example disclosed herein, in particular example 14, further comprising an exercise bar supported by a base structure configured to be mated together with the second board.

Example 20: The exercise device of any example disclosed herein, in particular example 19, wherein the base structure comprises a fixed extremity platform.

Example 21: The exercise device of any example disclosed herein, in particular example 20, wherein the base structure further comprises a dock for one or more handled resistance bands.

Example 22: The exercise device of any example disclosed herein, in particular example 19, wherein the exercise bar has a crossbar portion that runs along the widthwise dimension when the base structure is mated together with the second board.

Example 23: The exercise device of any example disclosed herein, in particular example 14, wherein the raised ridge structure has a trapezoidal shape with opposite-facing ramp surfaces facing in a lengthwise dimension of the exercise device.

Example 24: An exercise system comprising a chassis comprising a first board, a second board having one or more linear rails running along a lengthwise dimension of the chassis, a sled platform configured to couple to the one or more linear rails in a sliding engagement, and a resistance band dock coupled between the first board and the second board, and an exercise bar stand comprising a fixed standing platform, first and second leg bases including lateral stabilizers disposed on opposite sides of the fixed standing platform, and an exercise bar projecting vertically from the first and second leg bases and including a horizontal crossbar portion.

Example 25: The exercise system of any example disclosed herein, in particular example 24, further comprising one or more handlebars emanating from the exercise bar and extending in dimension perpendicular to the crossbar portion of the exercise bar.

Example 26: The exercise system of any example disclosed herein, in particular example 24, wherein vertical portions of the exercise bar have one or more handle docks associated therewith.

Example 27: The exercise system of any example disclosed herein, in particular example 24, wherein the first and second lateral stabilizers have horizontally-oriented bar docks configured to hold the exercise bar in a horizontal orientation.

Example 28: The exercise system of any example disclosed herein, in particular example 24, wherein the exercise bar stand comprises a raised foot stopper disposed proximal of at least a portion of the fixed standing platform.

Example 29: The exercise system of any example disclosed herein, in particular example 28, wherein the raised foot stopper extends between the first and second leg bases.

Example 30: The exercise system of any example disclosed herein, in particular example 29, wherein the raised foot stopper is an integrated form with the first and second leg bases.

Example 31: The exercise system of any example disclosed herein, in particular example 24, wherein the fixed standing platform includes a first standing area on a first longitudinal side of the exercise bar, and a second standing area on a second longitudinal side of the exercise bar.

Example 32: The exercise system of any example disclosed herein, in particular example 24, wherein, when the exercise bar is positioned in a standing position on a ground surface, the first and second leg bases hold the fixed standing platform in an elevated position above the ground surface.

Example 33: The exercise system of any example disclosed herein, in particular example 32, wherein the first board is configured to be slidable at least partially under at least a portion of the fixed standing platform, such that a first portion of the first board is disposed in a space between the standing platform and the ground surface and between the first and second leg bases.

Example 34: The exercise system of any example disclosed herein, in particular example 33, wherein when the first portion of the first board is positioned in the space, a second portion of the first board is exposed.

Example 35: The exercise system of any example disclosed herein, in particular example 34, wherein the second portion of the first board includes a exercise handle dock for coupling with an exercise handle.

Example 36: An exercise system comprising a segmented support board comprising a first wing having a linear guide track associated therewith, an elongate docking ridge structure coupled on a first long side to the first wing, and a second wing coupled to a second long side of the docking ridge structure, and a balance bar stand comprising a bar-support base, a standing platform fixed to the bar-support base, and a balance bar coupled to the bar-support base.

Example 37: The exercise system of any example disclosed herein, in particular example 36, wherein first and second ends of the balance bar are coupled to first and second support legs of the bar-support base.

Example 38: The exercise system of any example disclosed herein, in particular example 36, wherein the segmented support board is foldable along the first long side and the second long side of the docking ridge structure.

Example 39: The exercise system of any example disclosed herein, in particular example 36, wherein the docking ridge structure comprises one or more anchor wells.

Example 40: The exercise system of any example disclosed herein, in particular example 39, wherein the one or more anchor wells are open on a top of the docking ridge structure.

Example 41: The exercise system of any example disclosed herein, in particular example 40, wherein the docking ridge structure includes one or more slots on a side of the docking ridge structure, each of the one or more slots being contiguous with one of the one or more anchor wells.

Example 42: The exercise system of any example disclosed herein, in particular example 36, further comprising a foot plate slidingly coupled to the linear guide track of the first wing.

Example 43: The exercise system of any example disclosed herein, in particular example 42, further comprising one or more resistance bands that couple the foot plate to the docking ridge structure.

Example 44: The exercise system of any example disclosed herein, in particular example 36, wherein at least one of the first wing or the second wing has a handle aperture.

Example 45: The exercise system of any example disclosed herein, in particular example 36, wherein the second wing is dimensioned to slide under the standing platform of the balance bar stand.

Example 46: A method of using an exercise system, the method comprising providing a base plate module including a first panel, a second panel, and a resistance band docking module disposed between the first panel and the second panel with respect to a longitudinal dimension of the base plate module, providing an exercise bar module including a bar support base, a standing platform fixed to the bar support base, and an exercise bar coupled to the bar support base, and sliding the first panel of the base plate module at least partially under the standing platform of the exercise bar module.

Example 47: The method of any example disclosed herein, in particular example 46, further comprising unfolding the base plate module from a stowed configuration to an open configuration.

Example 48: The method of any example disclosed herein, in particular example 47, wherein, in the stowed configuration, longitudinal ends of the first panel and the second panel are brought together.

Example 49: The method of any example disclosed herein, in particular example 48, wherein, in the stowed configuration, the base plate module has a triangular side profile.

Example 50: The method of any example disclosed herein, in particular example 47, further comprising carrying the base plate module in the stowed configuration at least in part by grasping one or more handles associated with longitudinal ends of the first panel and the second panel.

Example 51: The method of any example disclosed herein, in particular example 46, further comprising fixing the first panel to the exercise bar module.

Example 52: The method of any example disclosed herein, in particular example 46, wherein said sliding the first panel under the standing platform involves mating tongue feature of a first one of the first panel or the standing platform with a groove feature of a second one of the first panel or the standing platform.

Example 53: The method of any example disclosed herein, in particular example 46, further comprising sliding a gliding platform engaged with a linear track of the second panel.

Example 54: The method of any example disclosed herein, in particular example 53, wherein said sliding the gliding platform involves placing a first foot on the standing platform of the exercise bar module, placing a second foot on the gliding platform, and pushing the gliding platform away from the standing platform using the second foot.

Example 55: The method of any example disclosed herein, in particular example 54, wherein the gliding platform is coupled to the resistance band docking module by one or more resistance bands.

Example 56: The method of any example disclosed herein, in particular example 46, further comprising adjusting a height of the exercise bar relative to the bar support base.

Example 57: A method of using an exercise system, the method comprising providing a resistance training chassis including a first board; a second board having one or more guiderails running in a longitudinal direction, and a transverse-oriented resistance band dock disposed between the first board and the second board, and transitioning the resistance training chassis between a stowed configuration and an open configuration by flexing bases of the first and second boards at respective hinge connections to the resistance band dock.

Example 58: The method of any example disclosed herein, in particular example 57, further comprising coupling one or more resistance bands to the resistance band dock.

Example 59: The method of any example disclosed herein, in particular example 58, wherein said coupling the one or more resistance bands to the resistance band dock involves placing a first portion of a resistance band in an anchor well of the resistance band dock.

Example 60: The method of any example disclosed herein, in particular example 59, wherein the first portion of the resistance band is an anchor associated with an end of the resistance band.

Example 61: The method of any example disclosed herein, in particular example 59, further comprising coupling a second portion of the resistance band to a proximal dock of a foot sled configured to be slidingly coupled to the one or more guiderails of the second board.

Example 62: The method of any example disclosed herein, in particular example 59, further comprising covering at least a portion of the anchor well with a cover after said placing the first portion of the resistance band in the anchor well.

Example 63: The method of any example disclosed herein, in particular example 57, further comprising coupling a foot sled to the one or more guiderails.

Example 64: The method of any example disclosed herein, in particular example 63, further comprising pushing the foot sled away from the resistance band dock against resistance force of one or more resistance bands coupled between the foot sled and the resistance band dock.

Example 65: The method of any example disclosed herein, in particular example 57, further comprising attaching a foot platform to the first board.

Example 66: The method of any example disclosed herein, in particular example 57, further comprising holding a handle associated with an end portion of one or more of the first board or the second board.

Example 67: The method of any example disclosed herein, in particular example 66, further comprising hanging the resistance training chassis on a wall by engaging a wall-mount with the handle.

Example 68: An exercise kit comprising a resistance training chassis including, a first board, a second board having one or more guiderails running in a longitudinal direction, and a transverse-oriented resistance band dock disposed between the first board and the second board, a sliding foot platform couplable to the one or more guiderails, and an exercise bar module including a bar support base, a standing platform fixed to the bar support base, and an exercise bar couplable to the bar support base.

Example 69: The exercise kit of any example disclosed herein, in particular example 68, further comprising a plurality of resistance bands configured to couple the sliding foot platform to the resistance band dock.

Depending on the embodiment, certain acts, events, or functions of any of the processes or algorithms described herein can be performed in a different sequence, may be added, merged, or left out altogether. Thus, in certain embodiments, not all described acts or events are necessary for the practice of the processes.

Conditional language used herein, such as, among others, "can," "could," "might," "may," "e.g.," and the like, unless specifically stated otherwise, or otherwise understood within the context as used, is intended in its ordinary sense and is generally intended to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without author input or prompting, whether these features, elements and/or steps are included or are to be performed in any particular embodiment. The terms "comprising," "including," "having," and the like are synonymous, are used in their ordinary sense, and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list. Conjunctive language such as the phrase "at least one of X, Y and Z," unless specifically stated otherwise, is understood with the context as used in general to convey that an item, term, element, etc. may be either X. Y or Z. Thus, such conjunctive language is not generally intended to imply that certain embodiments require at least one of X, at least one of Y and at least one of Z to each be present.

It should be appreciated that in the above description of embodiments, various features are sometimes grouped together in a single embodiment, Figure, or description thereof for the purpose of streamlining the disclosure and aiding in the understanding of one or more of the various inventive aspects. This method of disclosure, however, is not to be interpreted as reflecting an intention that any claim require more features than are expressly recited in that claim. Moreover, any components, features, or steps illustrated and/or described in a particular embodiment herein can be applied to or used with any other embodiment(s). Further, no component, feature, step, or group of components, features, or steps are necessary or indispensable for each embodiment. Thus, it is intended that the scope of the inventions herein disclosed and claimed below should not be limited by the particular embodiments described above, but should be determined only by a fair reading of the claims that follow.

It should be understood that certain ordinal terms (e.g., "first" or "second") may be provided for ease of reference and do not necessarily imply physical characteristics or ordering. Therefore, as used herein, an ordinal term (e.g., "first," "second," "third," etc.) used to modify an element, such as a structure, a component, an operation, etc., does not necessarily indicate priority or order of the element with respect to any other element, but rather may generally distinguish the element from another element having a similar or identical name (but for use of the ordinal term). In addition, as used herein, indefinite articles ("a" and "an") may indicate "one or more" rather than "one." Further, an operation performed "based on" a condition or event may also be performed based on one or more other conditions or events not explicitly recited.

Unless otherwise defined, all terms (including technical and scientific terms) used herein have the same meaning as commonly understood by one of ordinary skill in the art to which example embodiments belong. It be further understood that terms, such as those defined in commonly used dictionaries, should be interpreted as having a meaning that is consistent with their meaning in the context of the relevant art and not be interpreted in an idealized or overly formal sense unless expressly so defined herein.

The spatially relative terms "outer," "inner," "upper," "lower," "below," "above," "vertical," "horizontal," and similar terms, may be used herein for ease of description to describe the relations between one element or component and another element or component as illustrated in the drawings. It be understood that the spatially relative terms are intended to encompass different orientations of the device in use or operation, in addition to the orientation depicted in the drawings. For example, in the case where a device shown in the drawing is turned over, the device positioned "below" or "beneath" another device may be placed "above" another device. Accordingly, the illustrative term "below" may include both the lower and upper positions. The device may also be oriented in the other direction, and thus the spatially relative terms may be interpreted differently depending on the orientations.

Unless otherwise expressly stated, comparative and/or quantitative terms, such as "less," "more," "greater," and the like, are intended to encompass the concepts of equality. For example, "less" can mean not only "less" in the strictest mathematical sense, but also, "less than or equal to."

What is claimed is:

1. An exercise system comprising:
- a chassis comprising:
  - a first board;
  - a second board having one or more linear rails running along a lengthwise dimension of the chassis;
  - a sled platform configured to couple to the one or more linear rails in a sliding engagement; and
  - a resistance band dock coupled to and between adjacent sides of the first board and the second board;
  - wherein the first and second boards have substantially equivalent dimensions; and
- an exercise bar stand comprising:
  - a fixed standing platform;
  - first and second leg bases respectively including first and second lateral stabilizers disposed on opposite sides of the fixed standing platform; and
  - an exercise bar projecting vertically from the first and second leg bases and including a horizontal crossbar portion.

2. The exercise system of claim 1, further comprising one or more handlebars emanating from the exercise bar and extending in a dimension perpendicular to the horizontal crossbar portion of the exercise bar.

3. The exercise system of claim 1, wherein vertical portions of the exercise bar have one or more handle docks associated therewith.

4. The exercise system of claim 1, wherein the first and second lateral stabilizers have horizontally-oriented bar docks configured to hold the exercise bar in a horizontal orientation.

5. The exercise system of claim 1, wherein the exercise bar stand comprises a raised foot stopper disposed proximal to at least a portion of the fixed standing platform.

6. The exercise system of claim 5, wherein the raised foot stopper extends between the first and second leg bases.

7. The exercise system of claim 6, wherein the raised foot stopper is in an integrated form with the first and second leg bases.

8. The exercise system of claim 1, wherein the fixed standing platform includes:
- a first standing area on a first longitudinal side of the exercise bar; and
- a second standing area on a second longitudinal side of the exercise bar.

9. The exercise system of claim 1, wherein, when the exercise bar is positioned in a standing position on a ground surface, the first and second leg bases hold the fixed standing platform in an elevated position above the ground surface.

10. The exercise system of claim 9, wherein the first board is configured to be slidable at least partially under at least a portion of the fixed standing platform, such that a first portion of the first board is disposed in a space between the fixed standing platform and the ground surface and between the first and second leg bases.

11. The exercise system of claim 10, wherein when the first portion of the first board is positioned in the space, a second portion of the first board is exposed.

12. The exercise system of claim 11, wherein the second portion of the first board includes an exercise handle dock for coupling with an exercise handle.

* * * * *